US011730982B2

(12) United States Patent
Dobson et al.

(10) Patent No.: US 11,730,982 B2
(45) Date of Patent: Aug. 22, 2023

(54) RESCUE TUBE

(71) Applicant: Cleveland Reclaim Industries, Lorain, OH (US)

(72) Inventors: Dale Wayne Dobson, Hodgenville, KY (US); Matthew Svoboda, North Ridgeville, OH (US); Donald M. Malec, North Ridgeville, OH (US)

(73) Assignee: Cleveland Reclaim Industries, Lorain, OH (US)

( * ) Notice: Subject to any disclaimer, the term of this patent is extended or adjusted under 35 U.S.C. 154(b) by 67 days.

(21) Appl. No.: 16/860,699

(22) Filed: Apr. 28, 2020

(65) Prior Publication Data

US 2021/0236864 A1 Aug. 5, 2021

Related U.S. Application Data

(63) Continuation-in-part of application No. 15/880,924, filed on Jan. 26, 2018, now abandoned, which is a continuation-in-part of application No. 29/578,101, filed on Sep. 19, 2016, now Pat. No. Des. 809,210.

(51) Int. Cl.
*A62B 33/00* (2006.01)

(52) U.S. Cl.
CPC ..... *A62B 33/00* (2013.01)

(58) Field of Classification Search
CPC ..... A62B 33/00; A62B 3/00; A62B 99/00; A61G 1/01; A61G 1/013; A61G 7/1026; A61G 7/1023; A61G 7/1051; F16B 5/0016; Y10T 403/606; Y10T 24/141; Y10T 24/1457; Y10T 24/1461; Y10T 24/148; Y10T 24/1469
USPC ..... 182/230
See application file for complete search history.

(56) References Cited

U.S. PATENT DOCUMENTS 155,848 A * 10/1874 Adams ..... F16L 33/025 24/23 EE
176,555 A * 4/1876 Scholfield ..... B65B 67/12 141/390
228,002 A 5/1880 Swope
283,837 A 8/1883 Wallace
(Continued)

OTHER PUBLICATIONS

Office Action from related U.S. Appl. No. 15/880,924 dated Oct. 28, 2019.

*Primary Examiner* — Daniel P Cahn
*Assistant Examiner* — Shiref M Mekhaeil
(74) *Attorney, Agent, or Firm* — Calfee, Halter & Griswold LLP

(57) ABSTRACT

A rescue device for assisting in removing an individual from a confined space comprises a sheet comprising a high-density polyethylene having first and second ends and a projection extending laterally outward from the first end and has a top edge, a bottom edge, a projection edge, and a securing element. The sheet has first and second through apertures inset from the second end and aligned with the projection. The sheet is rollable between an undeployed position wherein the sheet has a reduced diameter and a deployed position wherein the projection is passed through the first and second through apertures and partially secured by the securing element. In the deployed position, the securing element may abut the sheet and retain the device in the deployed position.

12 Claims, 21 Drawing Sheets

(56) References Cited

U.S. PATENT DOCUMENTS 1,116,770 A * 11/1914 Warne ..... B65D 9/12 256/25
1,548,682 A * 8/1925 Gulin ..... A01G 13/0243 229/4.5
1,705,895 A * 3/1929 Blair ..... F16L 33/035 24/20 R
1,879,950 A * 9/1932 Read, Jr. ..... B65D 25/16 53/145
1,975,510 A * 10/1934 Hiatt ..... B65D 25/16 217/3 FC
2,059,906 A * 11/1936 Prestwich ..... B65D 63/04 24/20 EE
2,140,932 A 12/1938 Avery
2,156,583 A * 5/1939 Chaplin ..... B65D 63/1027 206/509
2,220,913 A * 11/1940 Ringler ..... B65D 3/10 229/5.5
2,717,463 A 9/1955 Sindler
2,821,761 A * 2/1958 Meyers ..... B65D 5/30 229/5.5
2,939,614 A * 6/1960 Hill ..... A47J 31/40 141/93
3,208,478 A * 9/1965 Wadsworth ..... F16L 9/22 229/93
3,305,161 A 2/1967 Offer
3,358,692 A 12/1967 Proulx
3,577,695 A * 5/1971 Huybers ..... B21C 37/02 228/178
3,983,914 A * 10/1976 Benson ..... B65B 67/1238 141/390
4,023,374 A * 5/1977 Colbert ..... E02D 5/64 138/159
4,067,079 A 1/1978 Buchman
4,299,012 A * 11/1981 Oetiker ..... F16L 33/025 24/703.1
4,457,483 A * 7/1984 Gagne ..... B65F 1/1415 141/390
4,628,007 A * 12/1986 Ledsham ..... B65F 1/1415 229/5.5
D318,345 S 7/1991 Holmstrom
5,056,679 A * 10/1991 Lonczak ..... B65F 1/00 141/390
5,102,036 A 4/1992 Orr
RE33,934 E * 5/1992 Oetiker ..... F16L 33/025 24/19
D329,216 S * 9/1992 Beeley ..... D12/128
D332,930 S 2/1993 Clark
5,226,554 A * 7/1993 Dauphinais ..... B65F 1/1415 141/390
5,230,246 A * 7/1993 Oetiker ..... F16L 33/035 24/23 EE
D338,046 S 8/1993 Fisscher
5,372,269 A * 12/1994 Sutton ..... B65F 1/06 220/666
5,400,989 A * 3/1995 Gaskill ..... B65F 1/06 248/152
5,568,662 A * 10/1996 Gougelet ..... A61G 1/01 5/628
D387,170 S 12/1997 Schuster
5,713,107 A * 2/1998 Jan ..... F16B 2/08 24/23 EE
5,730,352 A * 3/1998 Deekes ..... B65D 59/06 229/125.17
D409,057 S 5/1999 Wagner
5,915,768 A * 6/1999 Young ..... B65B 67/12 15/257.1
5,984,963 A 11/1999 Ryan
D417,616 S 12/1999 Conway
D421,413 S 3/2000 Calkin
6,062,342 A * 5/2000 Dobson ..... A62B 33/00 182/230
6,223,928 B1 * 5/2001 Sheran ..... B65D 81/3886 220/495.11
6,340,037 B1 * 1/2002 Stafford ..... B65B 67/1205 141/391
6,343,956 B2 2/2002 Stickney
6,401,952 B1 6/2002 Ming
6,490,764 B1 12/2002 Bell
6,588,144 B1 7/2003 Staggs
D488,107 S 4/2004 Saunier
6,718,733 B2 4/2004 Kilmartin
D506,710 S 6/2005 Hurtado
6,953,213 B2 * 10/2005 Yardley ..... A01D 51/007 294/215
7,093,867 B2 * 8/2006 Yardley ..... A01G 20/43 294/152
7,547,024 B1 * 6/2009 Dell ..... B62B 15/00 119/725
7,810,820 B2 * 10/2010 Wolf ..... A61G 1/01 280/18
D639,519 S 6/2011 Gomez
3,066,163 A1 11/2011 Newcomb
D675,107 S 1/2013 Vulgamott
8,528,137 B2 9/2013 Johnson
8,887,327 B2 11/2014 Davis
D719,881 S 12/2014 Smart
D720,894 S 1/2015 Calkin
9,016,557 B2 4/2015 Wisecarver
9,056,715 B2 * 6/2015 Muse ..... B65F 1/1415
D746,386 S 12/2015 Mahoney
D774,653 S 12/2016 Christmas
D779,675 S 2/2017 Chapman
D809,210 S 1/2018 Dobson
D830,560 S 10/2018 Christmas
10,215,182 B2 * 2/2019 Wenger ..... F04D 19/002
11,058,592 B2 7/2021 Saxon
D940,242 S 1/2022 Wu
11,267,602 B2 * 3/2022 Willis ..... B65B 67/1205
2004/0234567 A1 11/2004 Dawson
2009/0232606 A1 * 9/2009 Penza ..... E04G 13/02 405/257
2010/0199435 A1 * 8/2010 Jensen ..... A61G 1/01 5/628
2010/0243650 A1 * 9/2010 Manley ..... B65B 67/1205 220/23.9
2011/0061162 A1 * 3/2011 Judge ..... A61G 7/1032 5/81.1 R
2011/0185504 A1 * 8/2011 Kenalty ..... A61G 1/044 280/30
2012/0305333 A1 * 12/2012 Coulthard ..... A62B 99/00 182/230
2013/0048426 A1 * 2/2013 Ekdahl ..... A62B 99/00 182/48
2013/0312918 A1 * 11/2013 Trenkler ..... E04B 2/7401 160/136
2014/0026892 A1 1/2014 Drake
2015/0216745 A1 8/2015 Christmas
2017/0194553 A1 * 7/2017 Ifju ..... F03G 7/065
2017/0354554 A1 * 12/2017 Wearley ..... A61G 1/01
2018/0235821 A1 * 8/2018 Wong ..... A61G 1/013
2018/0271723 A1 * 9/2018 Adkins ..... A61G 1/048
2018/0272160 A1 * 9/2018 Wielgat ..... A62B 5/00
2020/0359575 A1 11/2020 Wilson
2021/0236864 A1 8/2021 Dobson

* cited by examiner

RESCUE TUBE

RELATED APPLICATIONS

This is a continuation-in-part application of U.S. application Ser. No. 15/880,924, filed Jan. 26, 2018, which is a continuation-in-part application of U.S. Design application No. 29/578,101, filed Sep. 19, 2016, which issued as U.S. Design Pat. No. 809,210 on Jan. 30, 2018, the disclosures of all of which are incorporated herein by reference.

FIELD

The present disclosure relates generally to rescue devices, and in particular, to an adjustable rescue device for assisting in rescuing individuals who are trapped in a confined area of space.

BACKGROUND

Many farm accidents occur during the removal of grain, seed, or other granule substances from bins and silos. For example, when grain does not properly flow out of a silo, individuals will often go inside the silo, stand on top of the grain pile, and get caught in the grain when the grain begins to flow downward too rapidly. Individuals may also become trapped when vertically crusted grain dislodges and engulfs the individual, when the individual falls through crusted grain into a cavity created by unloading a portion of the grain, or when the victim becomes engulfed in grain while located in a grain transport vehicle. If the individual is not immediately pulled out, the individual may become engulfed in the grain which can possibly lead to suffocation and death of the individual.

Rescue devices have been developed to assist in rescuing such individuals. However, each of these devices has one or more setbacks which make rescuing an individual difficult. First, many silo doors are 20 inches wide by 30 inches high and storage space on fire trucks and other rescue vehicles are limited, so it is desirable for the device to be adjustable such that it may be stored in a small space and easily carried. As individuals may become engulfed quickly and entry into a silo by rescuers is difficult, the device must also be quickly deployable by an individual without the use of extra tools. As only one rescuer may get to the victim in time, the device should also be lightweight and maneuverable by one person, but must also be strong enough to prevent the surrounding grain from crushing or further engulfing the trapped individual. Accordingly, it is desirable to develop an adjustable rescue device that is capable of being stored in a small area or space, carried by an individual through a small area, quickly and easily deployed by a single individual, and maneuvered easily by a rescuer.

One such rescue device is described in U.S. Pat. No. 6,062,342 to Dobson, filed May 14, 1997 and granted May 16, 2000, which is incorporated by reference in its entirety except as directly conflicting herein.

SUMMARY

The present application discloses a rescue device to assist in removing an individual trapped in material in a confined space. In exemplary embodiments, the rescue device includes a sheet comprising a high-density polyethylene having a first end, a second end, a top edge, a bottom edge an upper portion, a first through aperture, and a second through aperture and a projection extending laterally outward from the first end and having a top edge, a bottom edge, a projection edge, and a securing element. The sheet is adapted to curl around and defines a plurality of hand receiving areas in the upper portion of the sheet. The first through aperture is inset from the second end and the second through aperture is inset from the first through aperture. The sheet is rollable between an undeployed position wherein the device has a reduced diameter and a deployed position wherein the projection is passed through the first and second through apertures and partially secured by the securing element.

According to another inventive aspect of the present application a method is provided for assisting in removing an individual trapped in material in a confined space. The method includes the steps of removing a band disposed around a rescue device disposed in an undeployed position, unrolling the rescue device to a deployed position having a larger diameter wherein a projection edge of a projection extending laterally outward from a first end of a sheet is inserted through a first through aperture and a second through aperture near a second end of the sheet, partially grasping the hand receiving areas to maneuver the rescue device substantially above the individual trapped in material in the confined space, and inserting the enclosure of the rescue device into the material in the confined space to place the enclosure adjacent to and around the trapped individual to provide a barrier between the material and the trapped individual to allow the trapped individual to be removed from the material in the confined space.

According to another inventive aspect of the present application, a rescue device may be provided to assist in removing an individual trapped in material in a confined space. In exemplary embodiments, the rescue device includes a sheet comprising a high-density polyethylene having a first end, a second end, a top edge, a bottom edge an upper portion, a first through aperture, and a second through aperture and a projection extending laterally outward from the first end and having a top edge, a bottom edge, a projection edge, and a securing element. The sheet is adapted to curl around and defines a plurality of hand receiving areas in the upper portion of the sheet. The first through aperture is inset from the second end and the second through aperture is inset from the first through aperture. The sheet is rollable between an undeployed position wherein the device has a reduced diameter and a deployed position wherein the projection is passed through the first and second through apertures and partially secured by the securing element. The first and through apertures are vertically aligned with the projection. In exemplary embodiments, the bottom edge is serrated. The projection is prevented from being retracted through the first through aperture when the securing element is engaged with the sheet in the deployed position.

Various objects and advantages will become apparent to those skilled in the art from the following detailed description of the invention, when read in the light of the accompanying drawings. It is to be expressly understood, however, that the drawings are for illustrative purposes and are not to be construed as defining the limits of the inventions.

BRIEF DESCRIPTION OF DRAWINGS

The above and other features and aspects of the present invention will become more apparent upon reading the following detailed description in conjunction with the accompanying drawings, in which.

DETAILED DESCRIPTION

Figure 1:
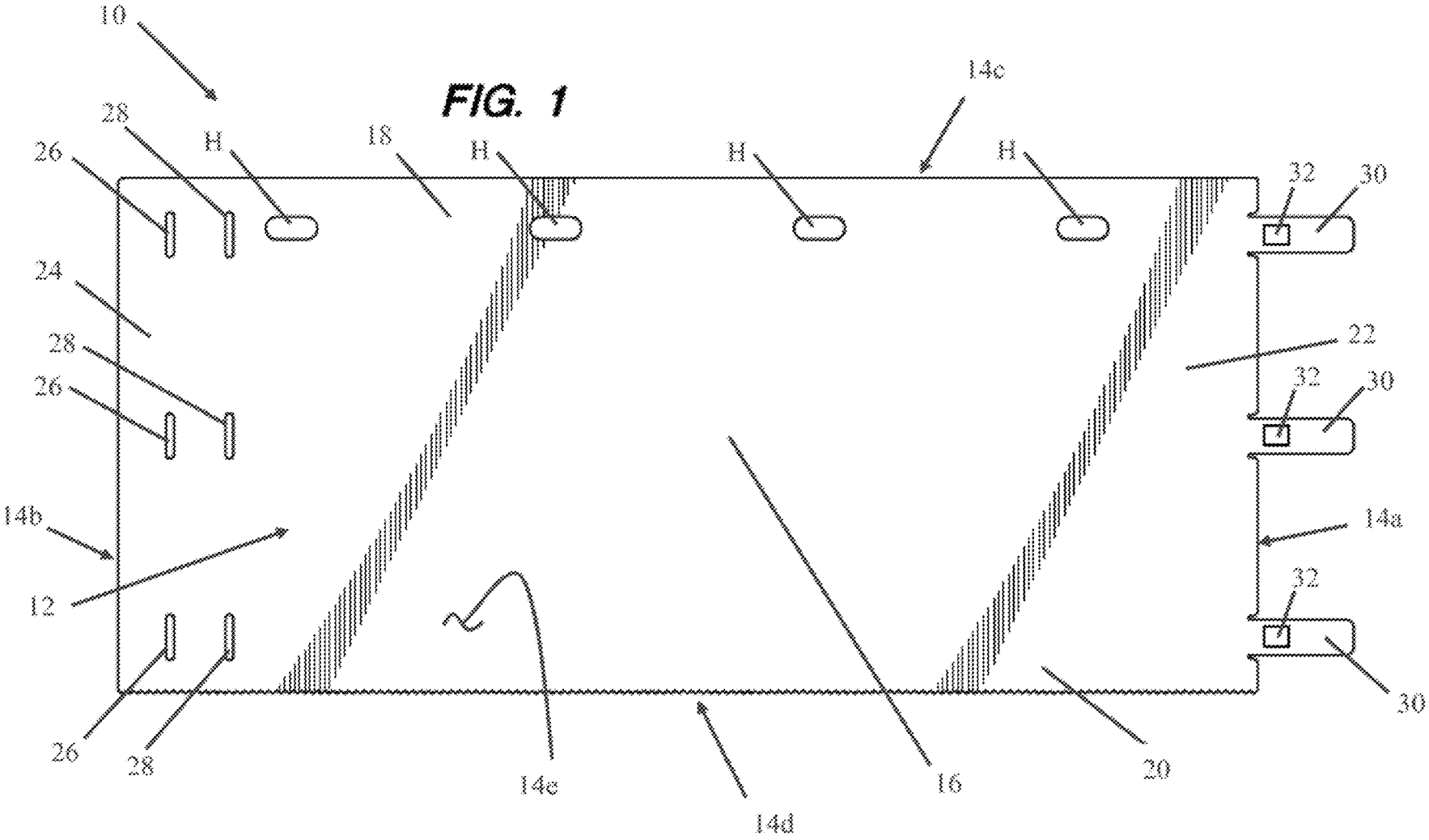
FIG. 1 is a top plan view of an exemplary rescue tube in a first state (a bottom plan view would be a mirror image thereof)
Figure 2:
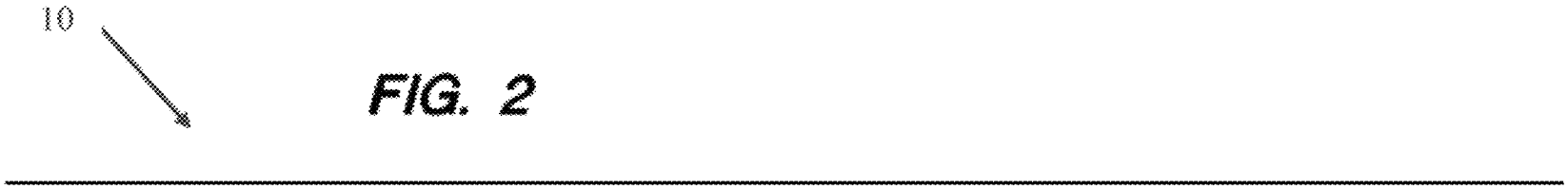
FIG. 2 is a left side elevation view of the rescue tube of FIG. 1 (a right side view would be a mirror image thereof)
Figure 3:
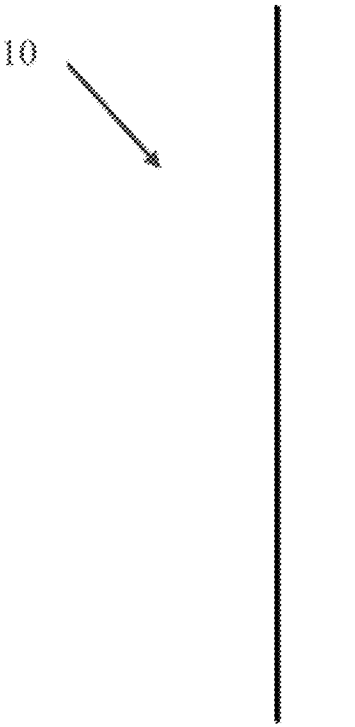
FIG. 3 is a front elevation view of the rescue tube of FIG. 1 (a rear view would be a mirror image thereof)
Figure 4:
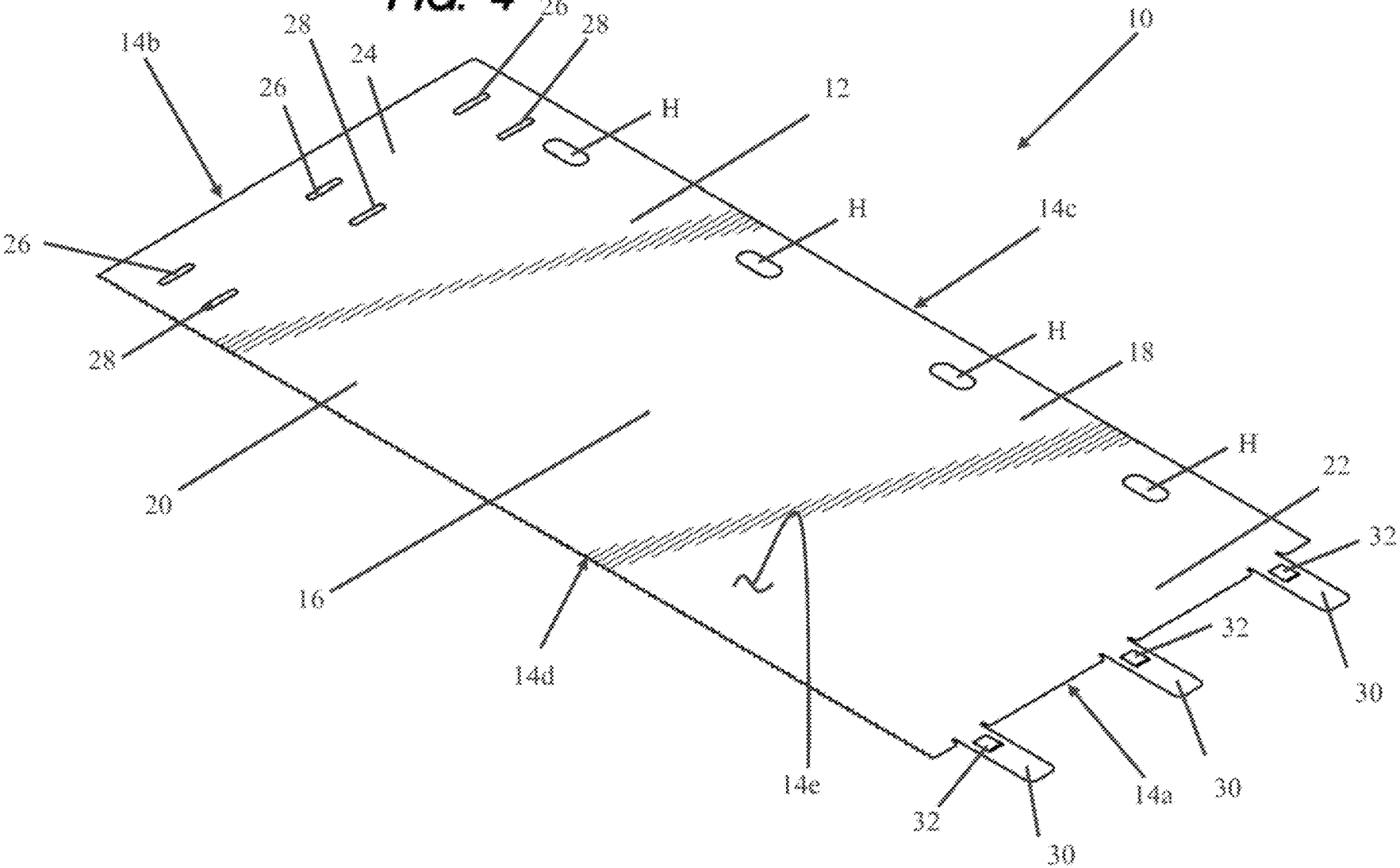
FIG. 4 is a front/top/right perspective view of the rescue tube of FIG. 1.
Figure 5:
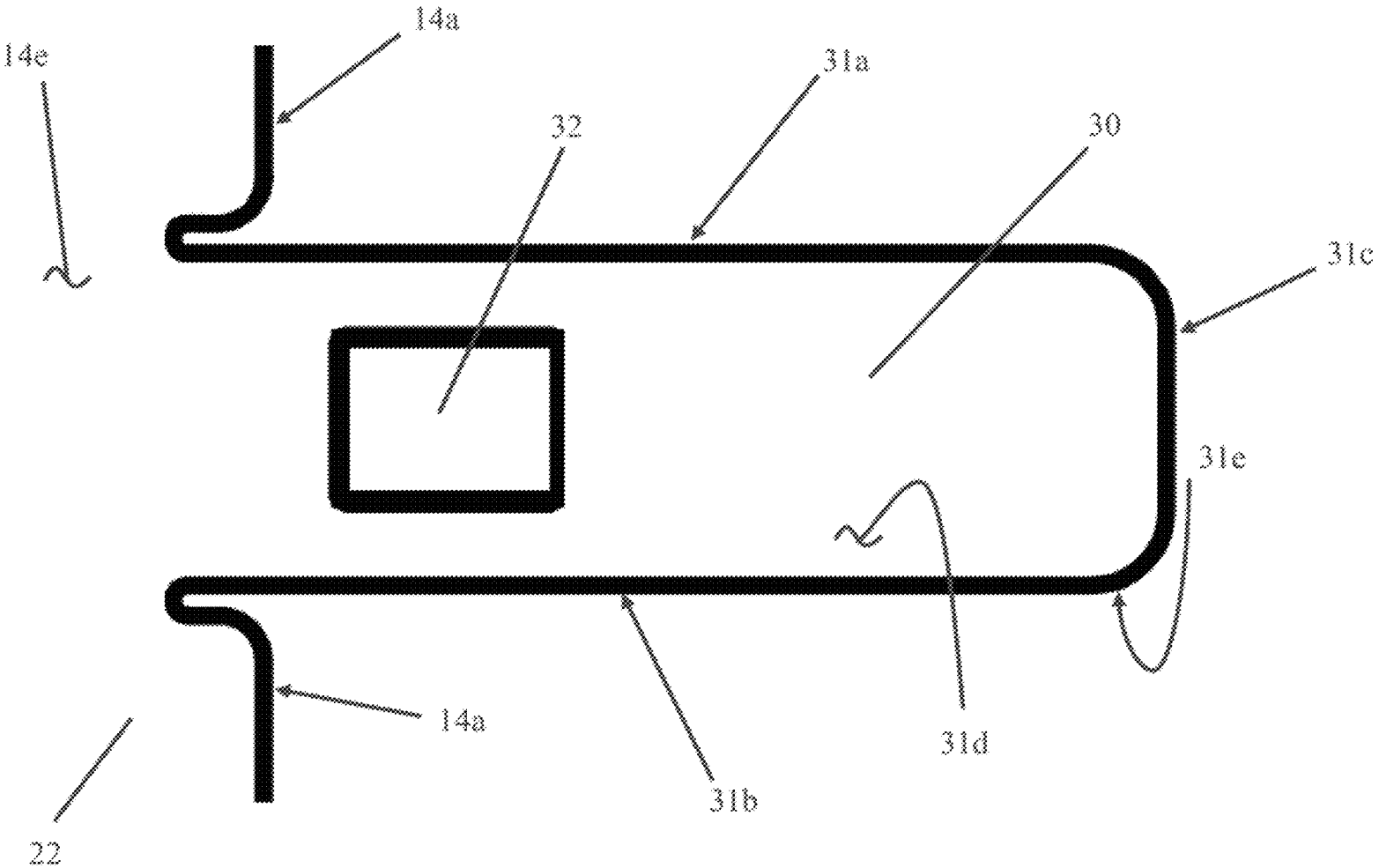
FIG. 5 is a top schematic view of an exemplary projection.

This Detailed Description merely describes exemplary embodiments of the invention and is not intended to limit the scope of the claims in any way. Indeed, the invention as claimed is broader than the exemplary embodiments, and the terms used in the claims have their full ordinary meaning, unless an express definition is provided herein.

The present invention provides a rescue device that may be easily transported to an accident site, such as a grain silo, and quickly deployed. According to one aspect of the present application, a rescue device may include a sheet which may be easily carried by a user into a grain silo and then quickly deployed by the same user. According to another aspect of the present application, a rescue device may include a sheet which may be moved from a undeployed state to a deployed state and, in the undeployed state, may be easily stored in a firetruck or other rescue vehicle. According to a further aspect of the present application, a rescue device may include quick release securing devices which allow the rescue device to be quickly deployed without the use of additional tools.

FIGS. 1-4 show an exemplary rescue device 10 in accordance with the principles of the invention. The exemplary rescue device 10 is an adjustable device used by rescue workers to remove an individual trapped in a granular material or substances in a confined area or space. For example, the rescue device 10 is especially useful in farm environments to assist in rescuing individuals trapped in a "whirlpool" of grain caused by a sudden rush of grain out of a silo.

Referring to FIGS. 1-4, 11-14, and 21, the exemplary rescue device 10 comprises a sheet 12 which is a flexible material and can be rolled or curled to form a tube-like shape. Because of the flexibility of the sheet 12, a rescue worker can roll the sheet 12 of the device 10 from a flat configuration (FIGS. 1-4) to a stored or undeployed configuration (FIG. 21) with a reduced diameter, to a deployed configuration (FIGS. 11-14), and virtually any desired diameter there between. This adjustability not only allows for the device 10 to be reduced in diameter to allow for easy entry into a narrow passage or confined space but also permits adjustability of the diameter of the device 10 to be sized according to the size of the individual trapped. The sheet is sized and designed such that it may entirely encompass a trapped individual and sufficiently repel the force of outside grain, yet also may be rolled into a small diameter for storage or fitting through a grain silo door and may easily be carried by one person.

Turning back to FIGS. 1-4, the sheet 12 has a first end 14*a*, a second end 14*b*, a top edge 14*c*, a bottom edge 14*d*, a front surface 14*e*, a rear surface 14*f* opposite the front surface 14*e* (FIGS. 13-14), and a sheet section 16 extending from the first end 14*a* to the second end 14*b* and from the top edge 14*c* to the bottom edge 14*d*. The sheet section 16 has an upper portion 18 near the top edge 14*c* of the sheet 12, a lower portion 20 near the bottom edge 14*d* of the sheet 12, a first portion 22 near the first end 14*a* of the sheet 12, and a second portion 24 near the second end 14*b* of the sheet 12.

The upper portion 18 of the sheet section 16 may include or define a plurality of carry slots or hand receiving areas H extending through the sheet 12. The plurality of hand receiving areas H may be sized and shaped to comfortably receive the fingers and/or hand of a user as the user grips the top portion of the rescue device 10. The plurality of hand receiving areas H are inset from and substantially parallel to the top edge 14*c* of the sheet 12 and, as will be described below, provide a rescuer with a place to insert his or her fingers when using the rescue device 10. The plurality of hand receiving areas H may be spaced apart from each other such that, as will be described below, at least two hand receiving areas H are arranged on substantially opposing sides of the rescue device 10 when the rescue device 10 is in a deployed position or state.

Additionally, the hand receiving areas H are inset from the top edge 14*c* a distance that will prevent the sheet 12 from ripping or tearing when the rescue device 10 is used. In preferred embodiments, the rescue device 10 has an even number of hand receiving areas H which are substantially evenly spaced apart from one another and the first and last hand openings H are relatively equally spaced from the first and second ends, 14*a* and 14*b*, respectively.

The hand receiving areas H are cut or otherwise milled into the sheet 12, e.g., the hand receiving areas H are laser cut into the sheet 12. Having simple hand receiving areas H which are cut or milled into the sheet 12 reduces the overall weight of the rescue device 10 and makes it easier to carry and use. In an exemplary embodiment, the hand receiving areas H are formed using a $CO_2$ laser or CNC milling.

The hand receiving areas H may be any shape which is easily manufactured and which is comfortably graspable by a user. In an exemplary embodiment, the hand receiving areas H are generally elongated circles or stadium shaped with the length of the hand receiving areas H extending in a direction parallel to the top edge 14*c*. In the illustrated embodiment, the sheet 12 defines four hand receiving areas H that are evenly spaced along the top edge 14*c*. However, other numbers and arrangements of hand openings H are contemplated. For example, the rescue device 10 may have more or fewer hand receiving areas H and the hand receiving areas H may be spaced apart in varying manners.

While the rescue device 10 has been described as having hand receiving areas H inset from the top edge 14*c* and extending through the sheet 12, other embodiments are contemplated. For example, handles may be added above or otherwise to the top edge 14*c* instead of milling or otherwise cutting the hand openings.

As shown in FIGS. 1-5, the rescue device 10 includes one or more projections 30 extending laterally outward from the first end 14*a* of the sheet 12. Each projection 30 may be substantially rectangular in shape and include a top edge 31*a*, a bottom edge 31*b*, a projection edge 31*c*, a front surface 31*d*, and a rear surface 31*e* opposite the front surface 31*e*. The projections 30 may be spaced along the first end 14*a* of the sheet 12 such that the projections 30 may substantially secure the rescue device 10 in the deployed position, as described below. For example, the projections 30 may be spaced along the first end 14*a* of the sheet12 such that the projections 30 span substantially the length of the first end 14*a*. In the illustrated embodiment, the rescue device 10 includes three projections 30. However, the rescue device 10 may include any number of projections 30. For example, the rescue device 10 may include one, two, or four or more projections 30.

As shown in FIGS. 1-4, the sheet section 16 has one or more first through apertures 26 disposed in the second portion 24 of the sheet 12 and inset from the second end 14*b*. The first through apertures 26 are aligned substantially parallel to the second end 14*b* and may be spaced along the second end 14*b* in corresponding vertical alignment (between the top and bottom edges 14*c*, 14*d*) with the projections 30. Each first through aperture 26 is sized, shaped, and configured to receive one of the projections 30. For example, the first through apertures 26 may have a height (extending between the top edge 14*c* and the bottom edge 14*d*) that is substantially equivalent to or larger than the distance between the top edge 31*a* and bottom edge 31*b* of the projection 30 and the first through apertures 26 may have a width (extending between the first end 14*a* and the second end 14*b*) that is substantially equivalent to or larger than the distance between the front surface 31*d* and the rear surface 31*e* of the projection 30.

The sheet section 16 also has one or more second through apertures 28 in the second portion 24 of the sheet 12 and inset farther from the second end 14*b* than the first through apertures 26. The second through apertures 28 may be aligned substantially parallel to the second end 14*b* and spaced along the second end 14*b* in vertical alignment with the projections 30 and the first through apertures 26. The second through apertures 28 may generally be the same size, shape, and configuration as the first through apertures 26. In preferred embodiments, the sheet section 16 has the same number of second through apertures 28 as first through apertures 26. The second through apertures 28 may be inset from the first through apertures 26 such that the projections 30 may be inserted through both the first through apertures 26 and the second through apertures 28 to secure the rescue device 10 in a deployed configuration, as described below.

In preferred embodiments, the rescue device 10 has the same number of projections 30, first through apertures 26, and second through apertures 28 and the projections 30, first through apertures 26, and second through apertures 28 are similarly spaced between the top and bottom edges 14*c*, 14*d* of the sheet 12. Additionally, the first through apertures 26 and the second through apertures 28 may be respectively inset a distance from the second end 14*b* that will prevent the sheet 12 from ripping or tearing when the rescue device 10 is in the deployed position and, when the device 10 is in a deployed position, will provide a cylindrical enclosure capable of rescuing an individual trapped in grain or other material.

As shown in FIGS. 1-5, the projection 30 may have a securing element 32 which may prevent or inhibit the projection 30 from being retracted through the first and/or second through apertures 26, 28 after the projection edge 31*c* has been inserted through the first and/or second through apertures 26, 28. The securing element 32 may be a configuration of the projection 30 or may be an additional component which is disposed on or affixed to the projection 30. The securing element 32 may permit part of the projection 30 to be inserted through the first and/or second through apertures 26, 28 and prevent or inhibit the projection 30 from being completely retracted through the first and/or second through apertures 26, 28, such as through abutting contact with the sheet 12 near the edge of the first and/or second through aperture 26, 28.

Figure 6:
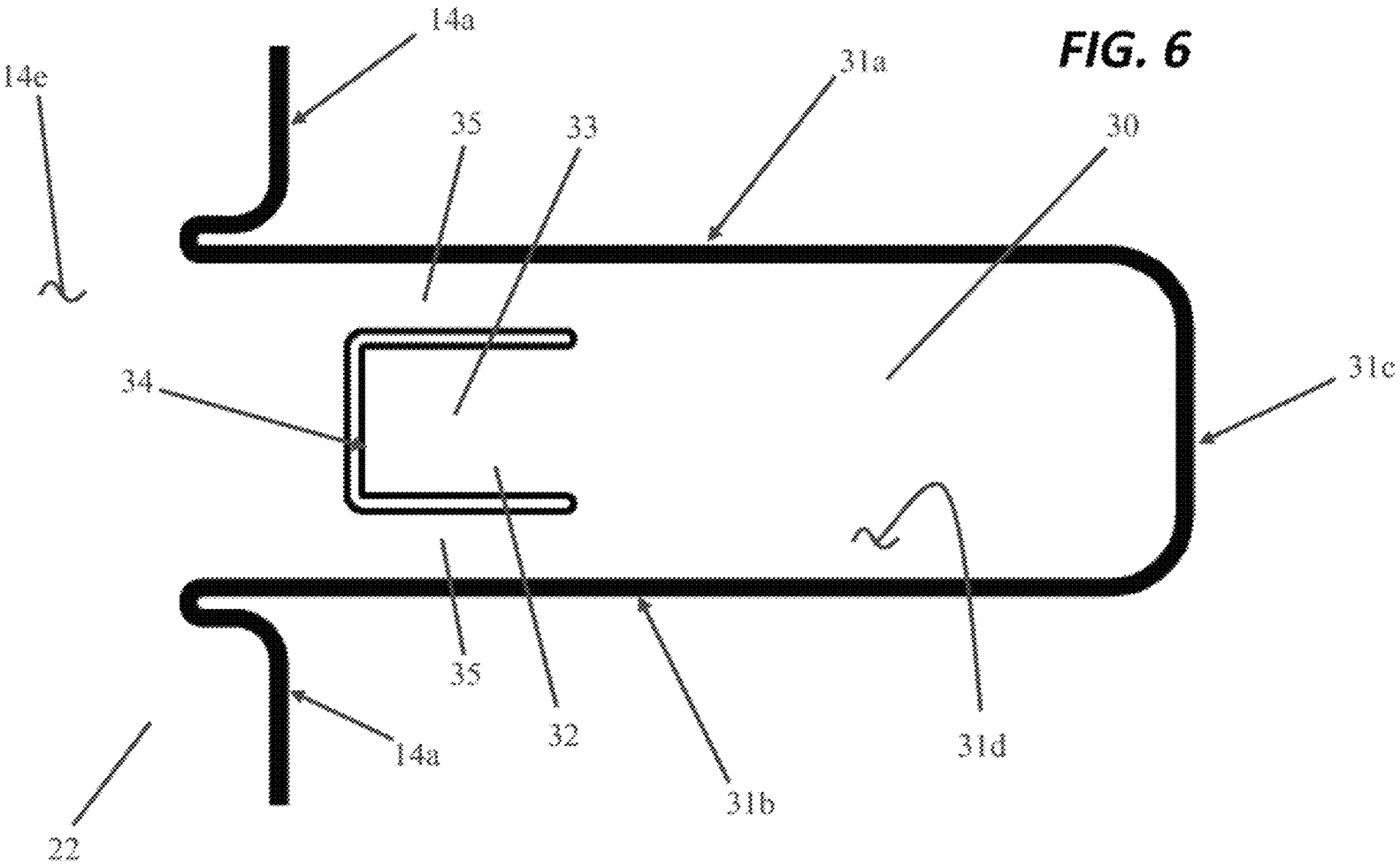
FIG. 6 is a top schematic view of an exemplary projection according to a second embodiment.
Figure 7:
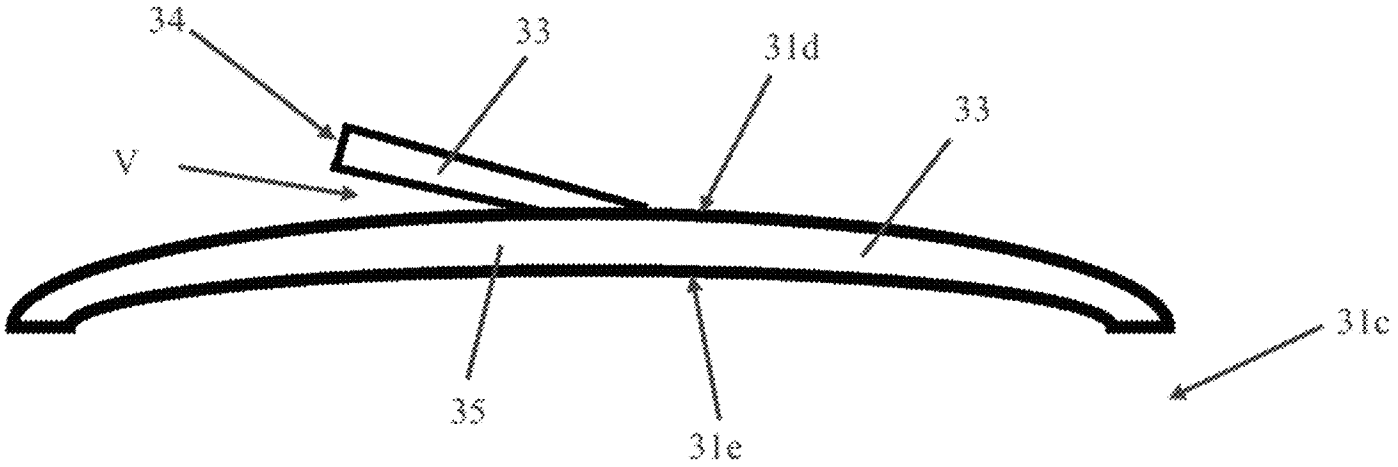
FIG. 7 is side view of the projection of FIG. 6 in a flexed position.

In some embodiments, as shown in FIGS. 6 and 7, the securing element 32 may be a clip 33 that is partially cut out of or from the projection 30. The clip 33 may be substantially rectangular and formed by cutting three sides of the clip 33 from the projection 30, thereby defining a clip edge 34 and two legs 35 between the clip 33 and the top and bottom edges 31*a*, 31*b* of the projection 30. The projection 30 may be configured or otherwise formed such that the clip edge 34 is oriented in the opposite direction as the projection edge 31*c*. The clip 33 of the projection 30 may be configured such that, when the projection 30 is curved, arched, or bent, the clip edge 34 extends or flexes away from the legs 35 and thereby defines a sheet receiving area V between the clip 33 and the legs 35.

In an exemplary embodiment, the clip 33 has a length (in the direction extending away from the first end 14*a*) of about 1.75 inches and has a height (extending between the top and bottom edges 14*c*, 14*d*) of about 1.24 inches. However, the clip 33 may have any suitable length and height.

Figure 8:
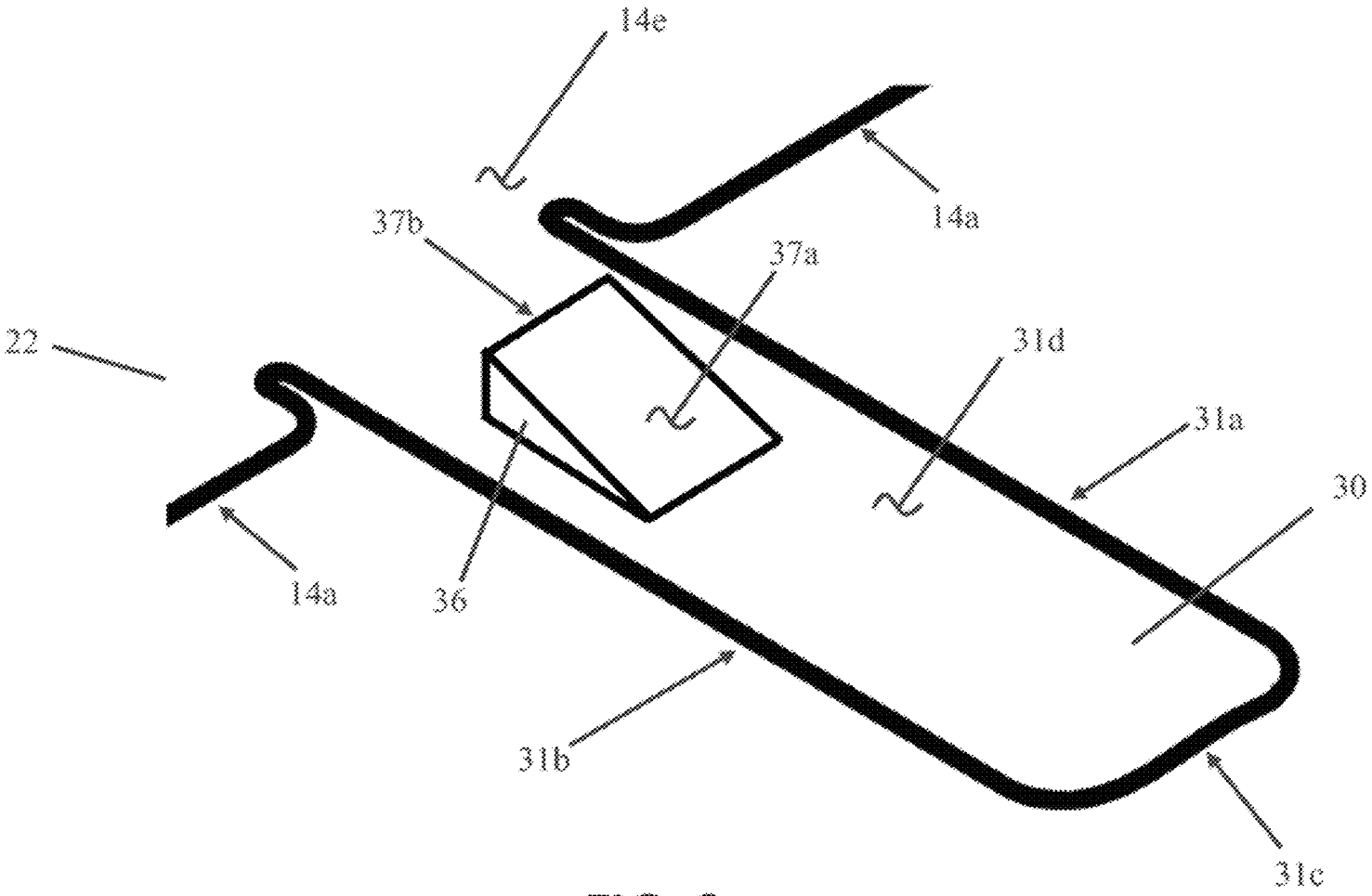
FIG. 8 is a perspective view of an exemplary projection according to a third embodiment.
Figure 9:
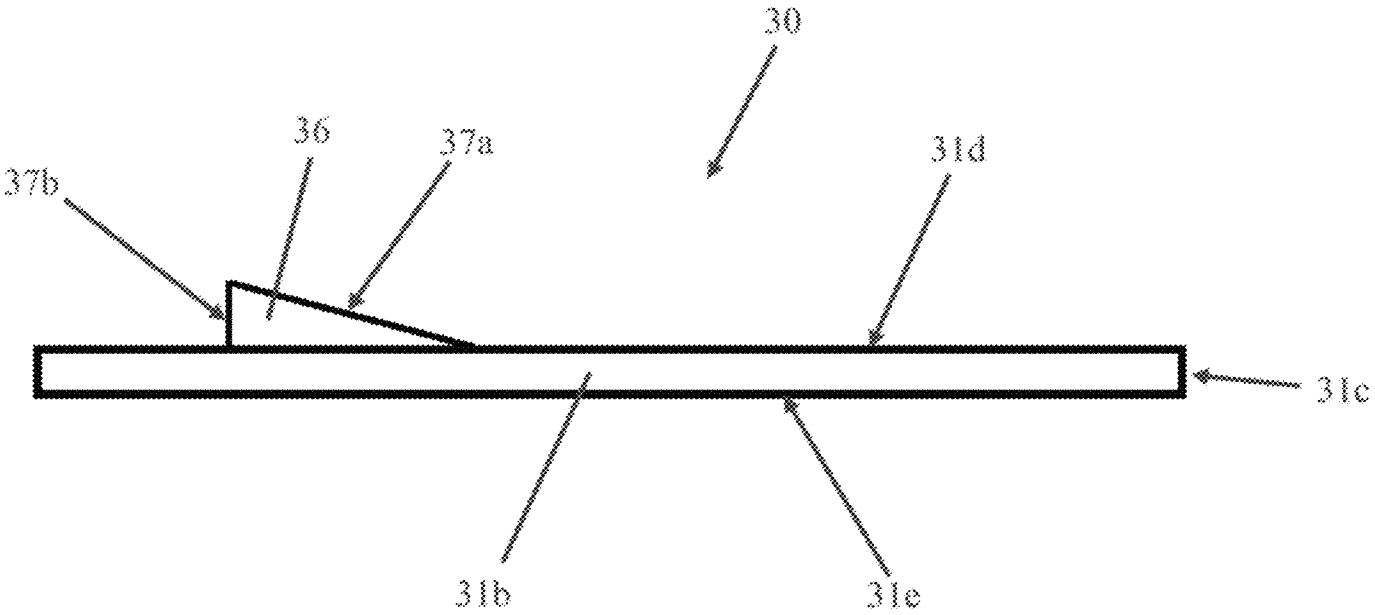
FIG. 9 is a side view of the projection of FIG. 8.

In other embodiments, as shown in FIGS. 8-9, the securing element 32 may be a stopper 36 which may abut the sheet 12 near the first or second through apertures 26, 28 when the rescue device 10 is in the deployed configuration, as described below. The stopper 36 may be any size, shape, or configuration which may be easily inserted or passed through the first and/or second through apertures 26, 28 but, once inserted therethrough, may make removal of the projection 30 through the first and/or second through apertures 26, 28 more difficult. The stopper 36 may have a yield surface 37*a* which may permit the projection 30 to be inserted through the first and/or second through apertures 26, 28 and an abutment surface 37*b* which may inhibit or prevent the projection 30 from being retracted through the first and/or second through apertures 26, 28. In the illustrated embodiment, the stopper 33 is wedge shaped wherein the yield surface 37*a* is inclined or ramped and the abutment surface 37*b* is substantially perpendicular to the remainder of the projection 30.

While the projection 30 has been described as having either a single clip 33 or a single stopper 36, the projection 30 may have any other suitable configuration which permit the projection 30 to be inserted through the first and/or second through apertures 26, 28 and prevent or inhibit the projection 30 from being retracted through the first and/or second through aperture 26, 28. For example, the securing element 32 may be a fastener, such as a bolt, buckle, tie, snap, screw, or nut, which may attach the projection 30 to the sheet 12 after the projection 30 has been inserted through the first and/or second through aperture 26, 28 and which may be undone and thereby permit retraction of the projection 30 through the first and/or second through aperture 26, 28. Further, the rescue device 10 may have any combination of securing elements 32. For example, one or more of the projections 30 may include both a clip 33 and a stopper 36 (FIGS. 19-20) or the rescue device 10 may have multiple projections 30 wherein at least one projection 30 has a first securing element 32, such as a clip 33, and at least one other projection 30 has a second securing element 32, such as a stopper 36

Figure 10:
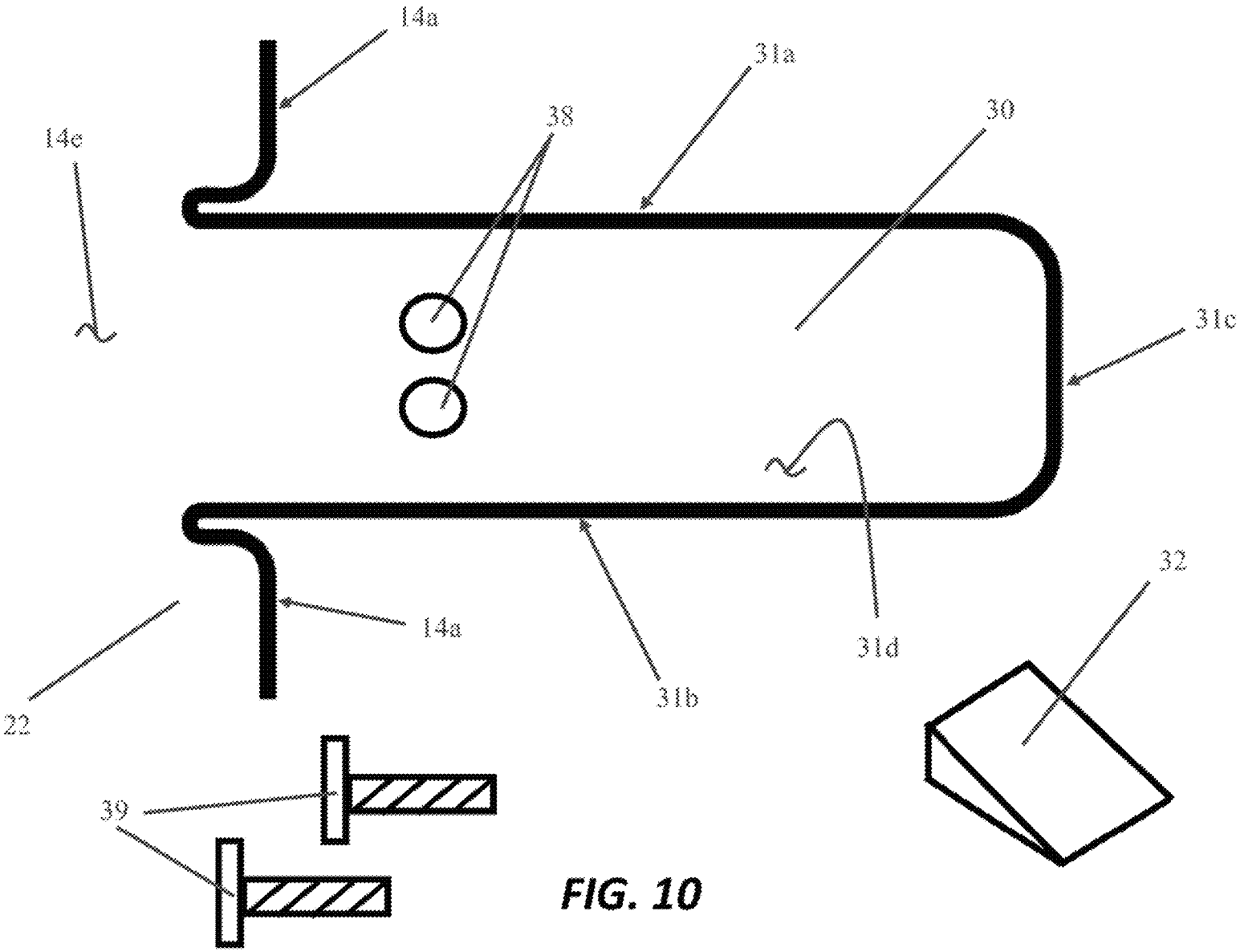
FIG. 10 is an exploded view of an exemplary projection according to a fourth embodiment.
Figure 11:
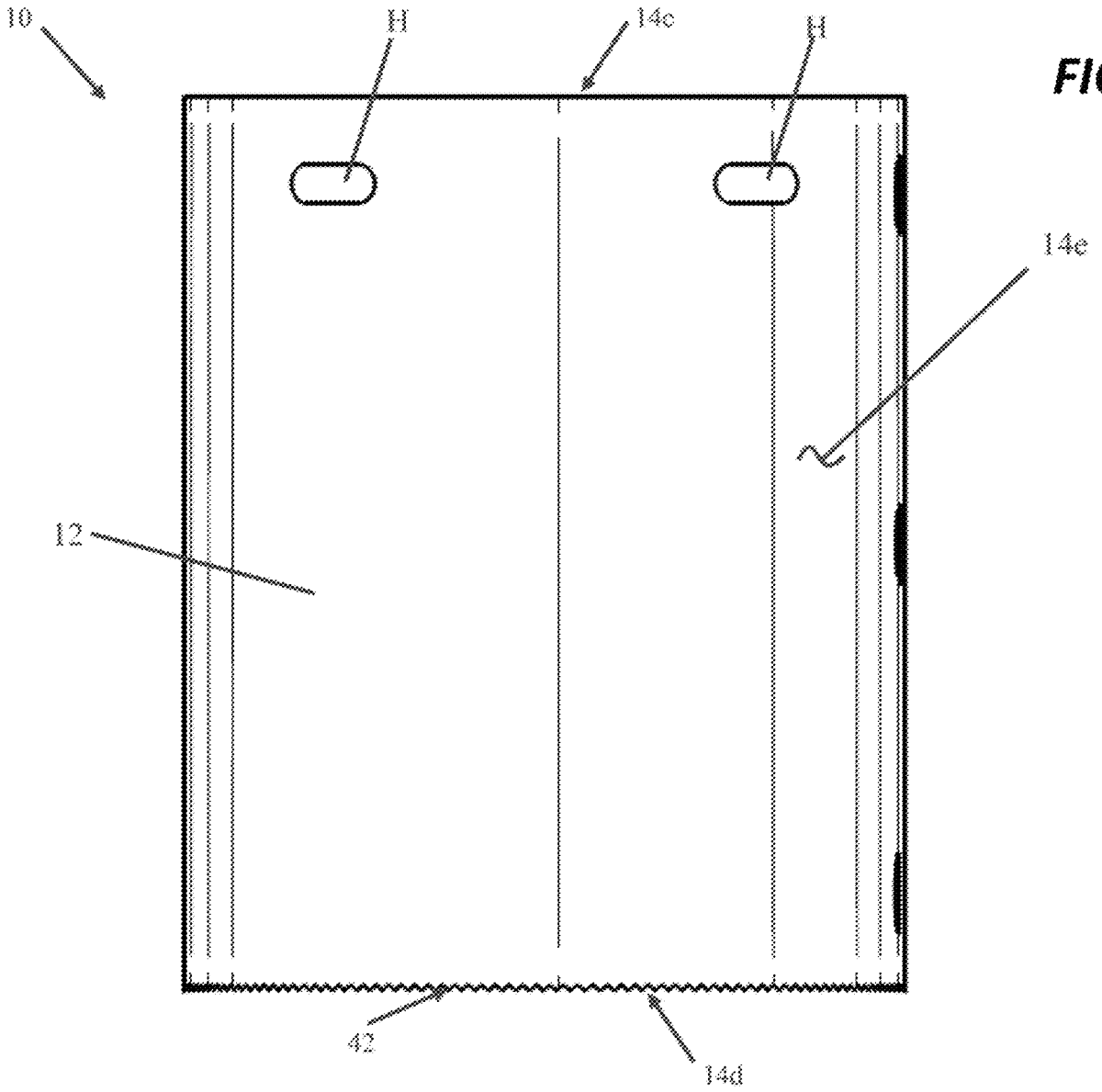
FIGS. 11 and 12 are side views of an exemplary rescue device in a deployed state.
Figure 12:
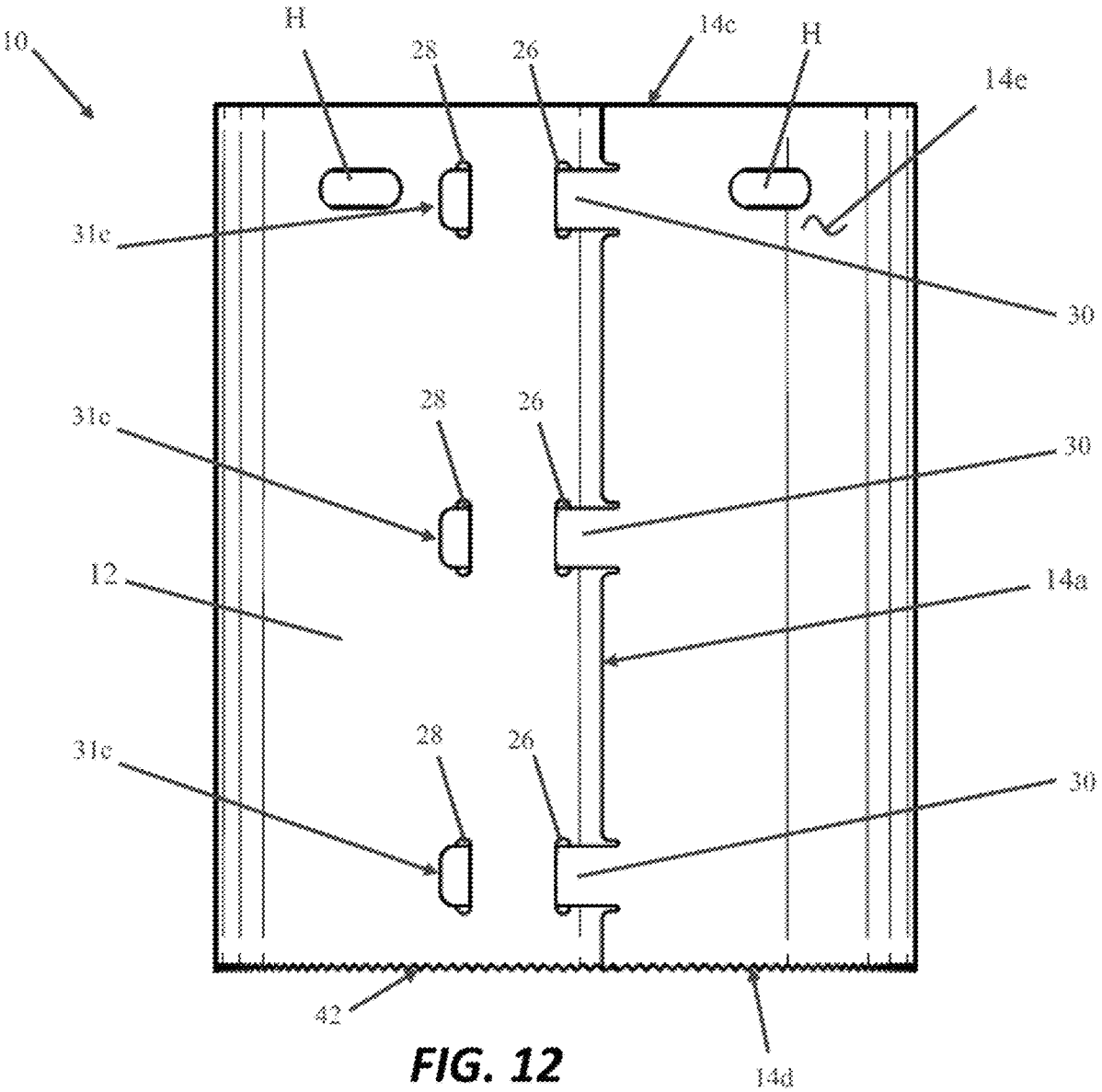
Figure 13:
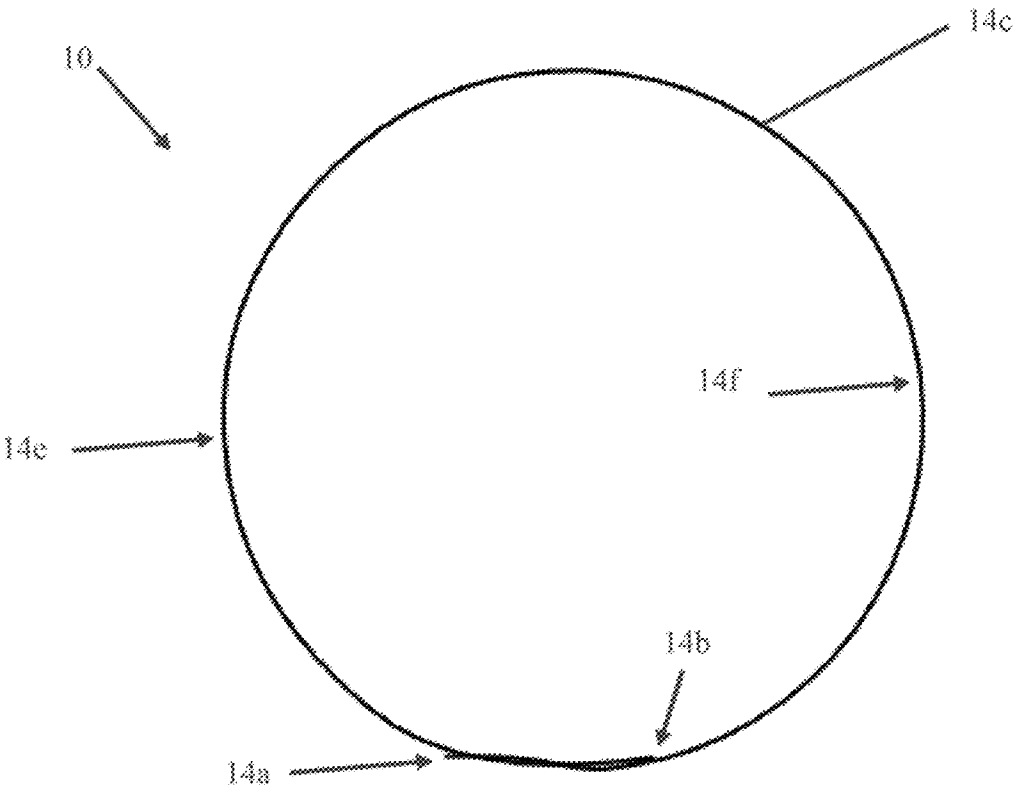
FIG. 13 is a top view of the rescue device of FIGS. 11 and 12.
Figure 14:
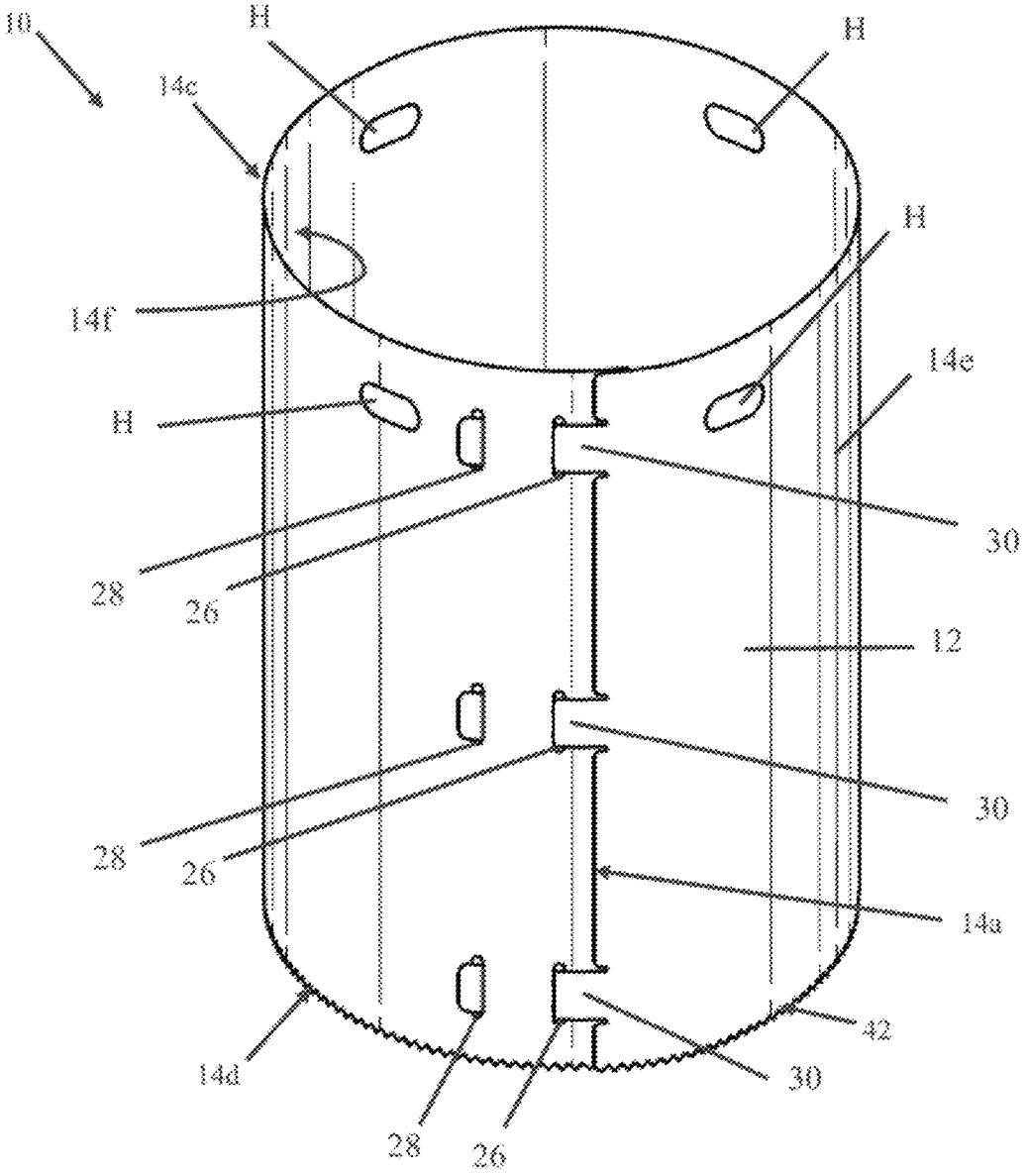
FIG. 14 is a perspective view of the rescue device of FIGS. 11 and 12.

As shown in FIG. 10, each projection 30 may also include one or more projection apertures 38 extending through the projection 30. The projection apertures 38 may be sized and shaped to receive a fastener 39 which may attach or otherwise secure the securing element 32 to the projection 30. The fastener 39 may be a screw, nail, clip, buckle, tie, bolt, or any other suitable fastener. In the illustrated embodiment, the projection 30 includes two projection apertures 38. However, the projection 30 may have suitable number of projection apertures 38. For example, the projection 30 may have one or three or more projection apertures 38.

Generally, the rescue device 10 is designed to be carried by one person, fit through a narrow entry to a grain silo, deployed quickly, and stored on a fire truck or other rescue vehicle in a limited space. The device 10 is also adjustable to a size that is large enough to a surround a person trapped in grain or other material and thick or strong enough to sufficiently retain outside grain from continuing to engulf the victim. In accordance with the present invention, the rescue tube 10 is comprised of one piece of flexible plastic. In exemplary embodiments, the rescue device 10 is rollable along the sheet section 16 and, in a deployed state, as will be explained below, provides a sturdy support when positioned around a trapped individual to act as a barrier between the individual and granular substance. Additionally, the sheet 12, is resilient enough to resist tearing, ripping, or other destruction when the device 10 is carried or used, particularly near the hand receiving areas H and first and second through apertures 26, 28. The sheet 12 is also lightweight and easily portable and has smooth and level front and rear surfaces 14*e*, 14*f* thereby helping to reduce friction when the rescue device 10 is pushed into the granular substances. The sheet 12, however, is not limited to the present embodiment, but can be any material which is easily adjustable and can function as some type of barrier means.

In an exemplary embodiment, the rescue tube 10 is made from a single sheet of high-density polyethylene (HDPE). In the illustrated embodiment, the sheet 12 is about 0.11 to 0.14 inches thick, such as between 0.115 and 0.135 inches thick, such as between 0.122 and 0.129 inches thick. In an exemplary embodiment, the sheet 12 is a single sheet of HDPE that is ⅛ of an inch thick.

In the illustrated embodiment, the rescue tube sheet 12 is about 96 inches in length (including the projections 30) and about 40 inches tall, the projections 30 extend about 7.5 inches outward from the first end 14*a*, and the projections 30 are about 2.75 inches in height. Also, the projections 30 are substantially spaced along the first end 14*a* such that the projections 30 are about 12.875 inches apart (about 15.625 inches apart on center). However, it will be appreciated that other sizes are contemplated. For example, the sheet may be between 84 and 108 inches long and between 48 and 60 inches tall. Additionally, the rescue device weighs between 17 and 19 pounds. In an exemplary embodiment, it is about 18 pounds. However, the size, weight, and material of the rescue device 10 may vary depending on the intended location or material in which the rescue device 10 is to be used. For example, a thickness greater than ⅛ inch may be beneficial for rescues from mud or from trench safety.

Referring now to FIGS. 1-4, 11-14, and 21, the rescue device 10 may be rolled from an initial unrolled or flat state (FIGS. 1-4) into a first, undeployed, or stored position (FIG. 21) and into a second, assembled, or deployed position (FIGS. 11-14). In exemplary embodiments, the rescue device 10 is securable in the undeployed and deployed positions.

Figure 21:
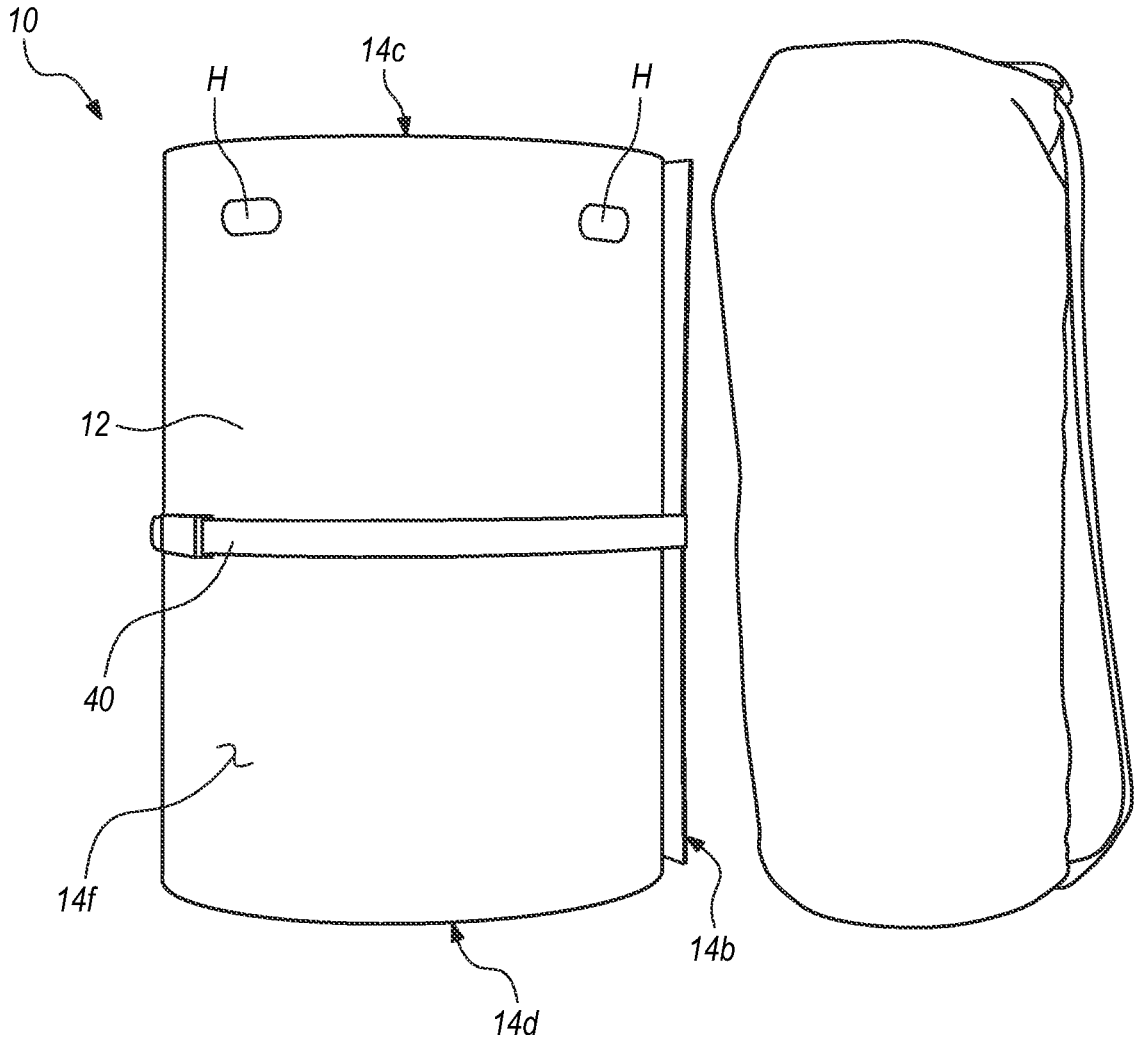
FIG. 21, is a side view of an exemplary implementation of a rescue device in an undeployed state.

As shown in FIG. 21, the rescue device 10 may be rolled into a first, undeployed, or stored position. In the undeployed or stored position, the rescue device 10 is rolled inwardly on itself, rolling either the first end 14*a* inwardly toward the second end 14*b* or the second end 14*b* inwardly toward the first end 14*a*, until the diameter of the rescue device 10 is significantly reduced. The rescue device 10 may be rolled inwardly on itself multiple times. The rescue device 10 may then be secured in the undeployed or stored position.

Further, the rescue device 10 is made of a material and designed such that, when the device 10 is in the rolled or undeployed state, the device 10 has a diameter between 10 and 25 inches. Generally, the rescue device 10 has a diameter between 10 and 19 inches when the device 10 is in the rolled state. In an exemplary embodiment, the rescue device is about 15 inches in diameter when in the rolled or undeployed state.

After the rescue device 10 has been rolled into the first, undeployed, or stored position, the rescue device 10 may be secured in the undeployed or stored position with a band 40 which may substantially surround the rescue device 10 and prevent the rescue device 10 from unrolling. The band 40 may be any suitable shape or configuration which may be slipped over or fastened around the rolled rescue device 10 and thereby retain the device 10 in the undeployed or stored position. For example, the band 40 may be a strap, tie, belt, harness, leash, ring, string, rope, tape or other suitable shape or composition. The band 40 may be elastic and/or may include a clasp, clamp, buckle, crank, or other suitable fastener such that the band 40 may be secured, fastened, and/or cinched around the rolled rescue 10 once the rescue device 10 has been rolled into the undeployed or stored position. The band 40 may be secured around the rescue device 10 after the rescue device 10 has been moved to the undeployed or stored position or the band 40 may be placed around the rescue device 10 and the band 40 may be tightened to move the rescue device 10 into the stored position.

As shown in FIGS. 11-20, the rescue device 10 may be rolled into a second, assembled, or deployed position. In the illustrated embodiments, the rescue device 10 is rolled in on itself such that the front surface 14*e* of the sheet 12 is facing radially outwardly and the rear surface 14*f* of the sheet 12 is facing radially inwardly. However, the rescue device 10 may also be rolled inwardly on itself such that the rear surface 14*f* of the sheet 12 is facing radially outwardly and the front surface 14*e* of the sheet 12 is facing radially inwardly.

When the rescue device 10 is rolled inwardly on itself, each of the one or more projections 30 may be substantially aligned with the corresponding first and second through apertures 26, 28. The projection end 31*c* of each of the projections 30 may be inserted through the corresponding first through aperture 26 and then through the corresponding second through aperture 28.

In some embodiments, as shown in FIGS. 11-14, the projection end 31*c* of the projections 30 may be inserted through the first through aperture 26 from the front surface 14*e* of the sheet 12 to the rear surface 14*f* of the sheet 12. The projection edge 31*c* of the projections 30 may then be passed through the second through aperture 28 from the rear surface 14*f* of the sheet 12 to the front surface 14*e* of the sheet 12. After the projection edge 31*c* has been passed through the first and second through apertures 26, 28, the rescue device 10 is in the deployed state and the device 10 may be used to fit around an individual trapped in grain or other material and impede surrounding grain or other material from continuing to engulf the individual. Once the projection edge 31*c* of the projection 30 has been inserted through the first and second through apertures 26, 28, the securing element 32 may prevent the projection 30 from being retracted back through the first and/or second aperture 26, 28, as described below.

While the projection 30 has been described as being passed through the first through aperture 26 from the front surface 14*e* of the sheet 12 to the rear surface 14*f* of the sheet 12 and through the second through aperture 28 from the rear surface 14*f* of the sheet 12 to the front surface 14*e* of the sheet 12, the projection 30 may be inserted through the first and second through apertures 26, 28 in any suitable manner. For example, the projection 30 may be passed through the first through aperture 26 from the rear surface 14*f* of the sheet 12 to the front surface 14*e* of the sheet 12 and through the second through aperture 28 from the front surface 14*e* of the sheet 12 to the rear surface 14*f* of the sheet 12, as illustrated in FIGS. 18-19.

Figure 15:
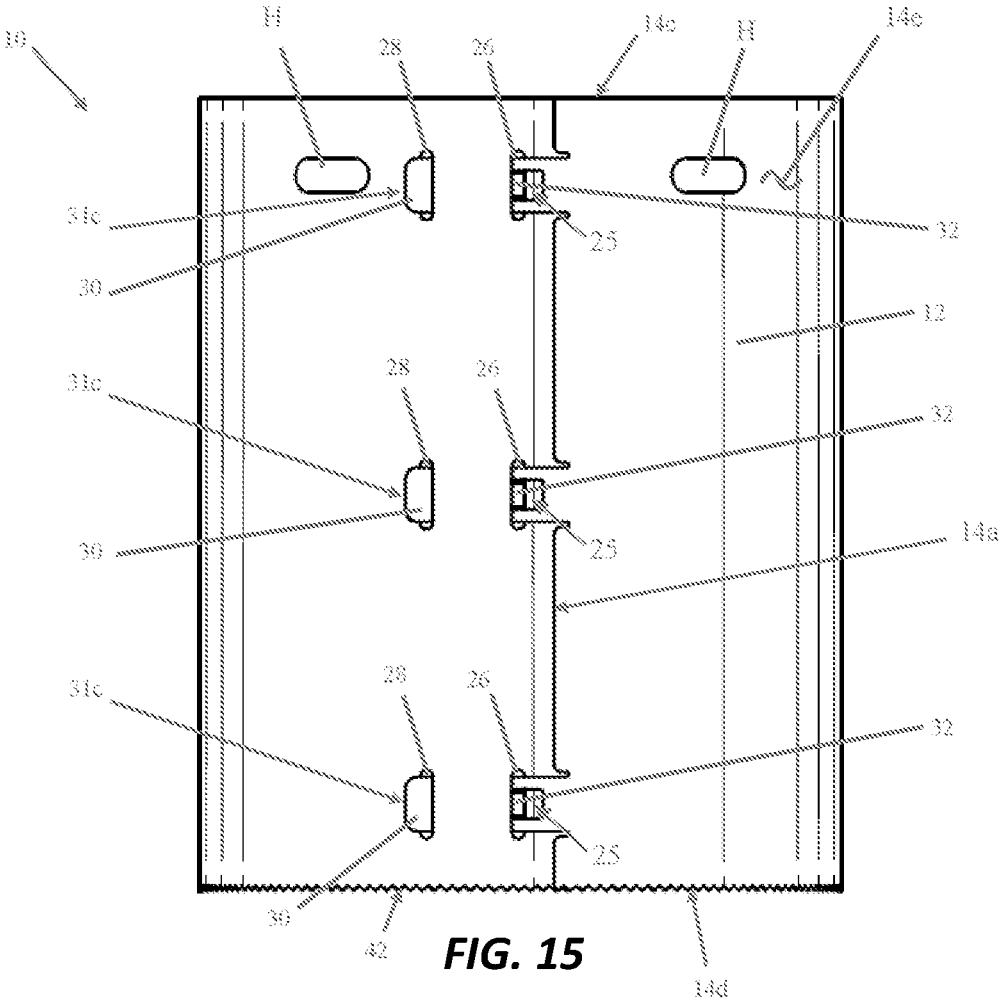
FIG. 15 is a side view of an exemplary rescue device of a second embodiment in a deployed state.
Figure 16:
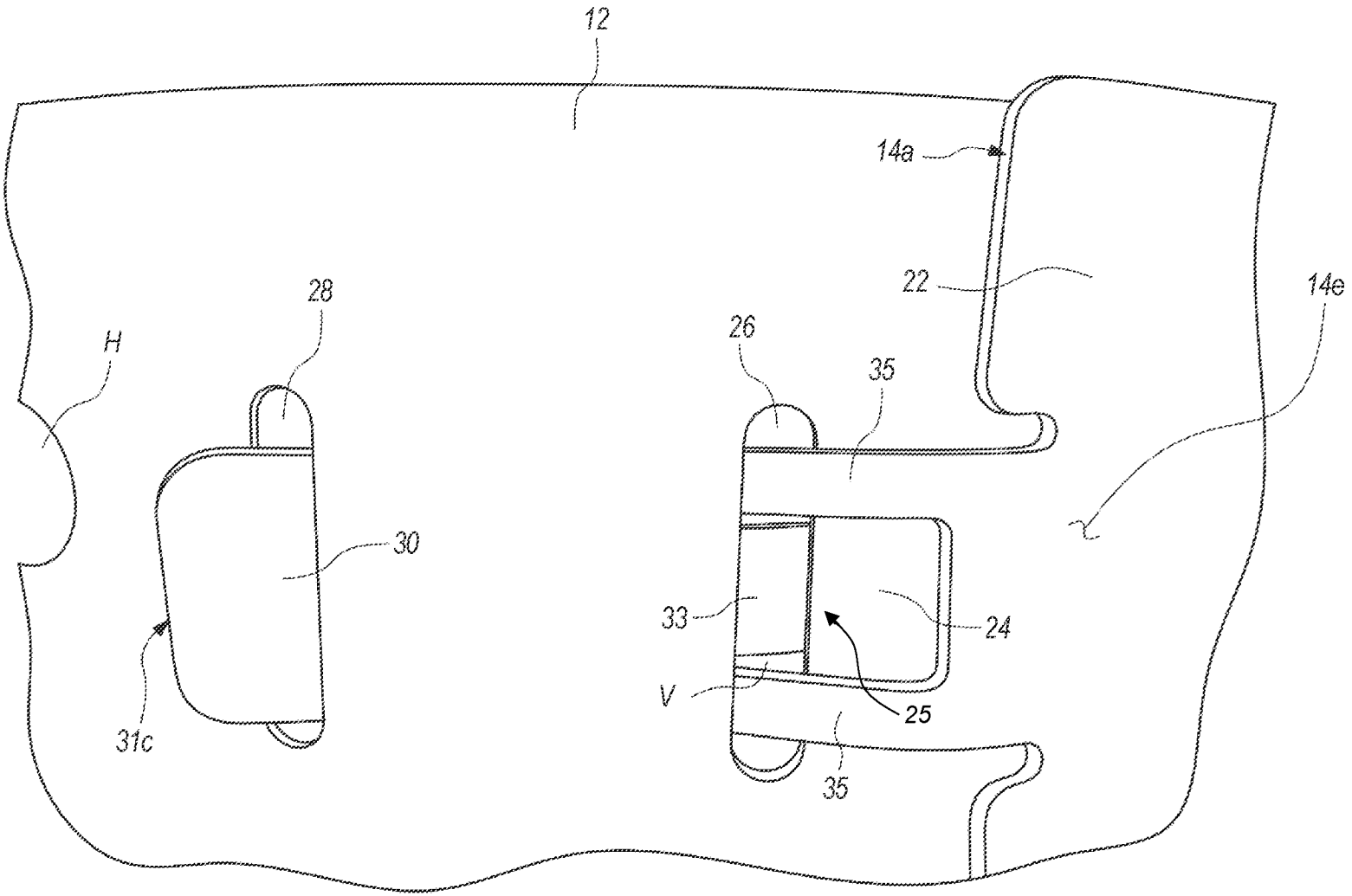
FIG. 16 is an outside view of an exemplary projection of an exemplary implementation of a rescue device secured in first and second through apertures.
Figure 17:
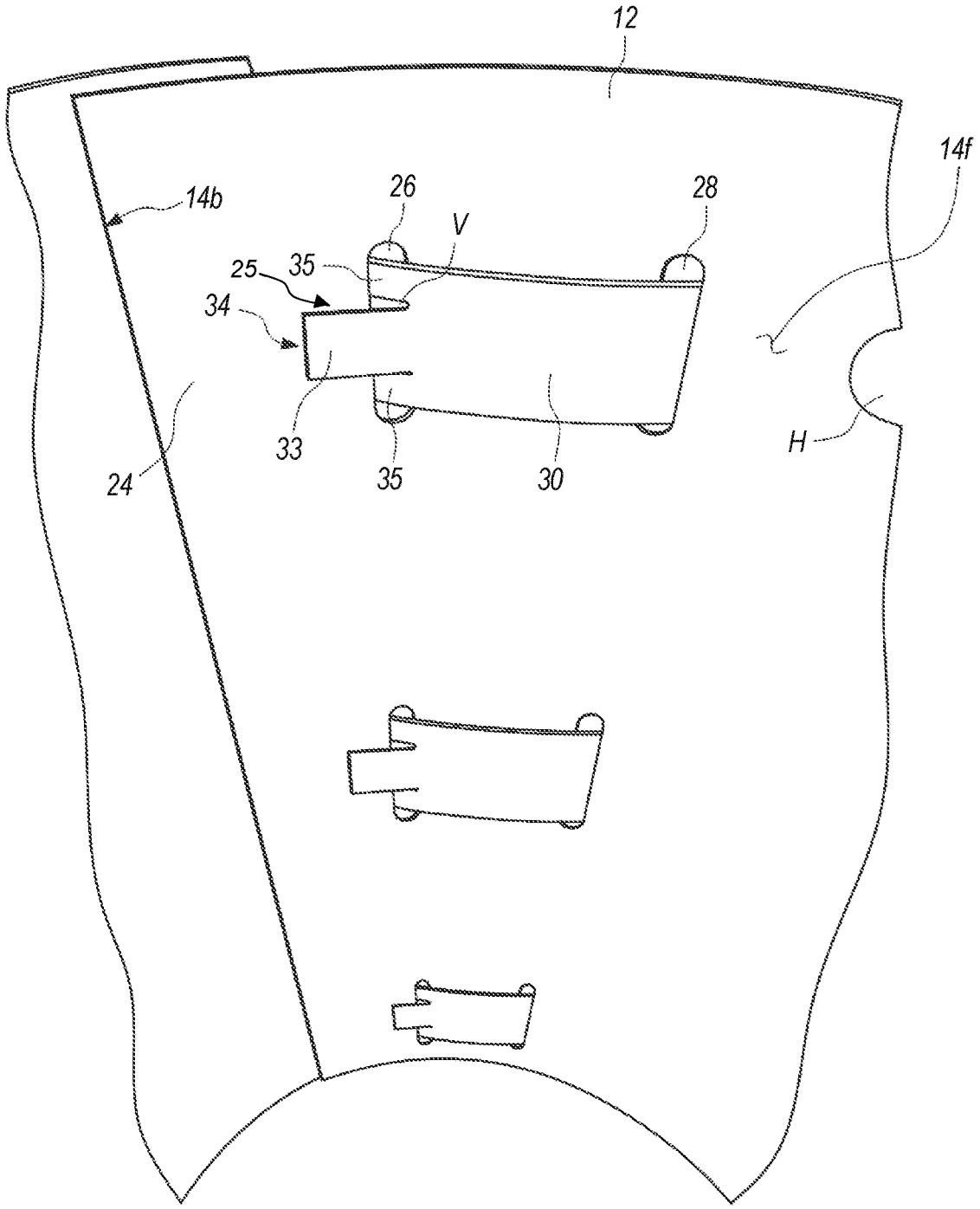
FIG. 17 is an inside view of the projection of FIG. 16 secured in the first and second through apertures.

As shown in FIGS. 15-17, In some embodiments, when the securing element 32 is the clip 33, the clip 33 may permit the projection 30 to be inserted through the first and second through apertures 26, 28 and prevent the projection 30 from begin retracted back through the first aperture 26. For example, the edge of the sheet 12 at the first through aperture 26 may pass over the clip 33 of the projection 30 as the projection 30 is passed through the first and second through apertures 26, 28. After the clip 33 has been passed through the first through aperture 26, the clip 33 may flex radially beyond the legs 35 and remainder of the projection 30. After the projection 30 has been inserted through the first and second through apertures 26, 28, the clip 33 may be disposed inside the rear surface 14*f* of the sheet 12 and at least a portion of the legs 35 of the projection 30 may be disposed outside the front surface 14*e* of the sheet12. In such a position, the edge of the sheet 12 near the first through aperture 26 and a portion 25 of the sheet 12 may be disposed in the sheet receiving area V defined between the clip 33 and the legs 35 of the projection 30. As the edge of the sheet 12 at the first through aperture 26 and the portion 25 of the sheet 12 is disposed in the sheet receiving area V (between the clip 33 and the legs 35 of the projection 30) and the clip 33 and the legs 35 of the projection 30 extend circumferentially beyond the first through aperture 26 toward the second edge 14*b* on both the front and rear surfaces 14*e*, 14*f* of the sheet 12, the projection 30 may be prevented from being retracted through the first aperture 26. The natural biasing force of the rescue device 10 to unroll from the deployed state may continually bias the edge of the sheet 12 at the first through aperture 26 and the portion 25 of the sheet 12 into the sheet receiving area V between the clip 33 and the legs 35 of the projection 30 and thereby retain the projection 30 in the first and second through apertures 26, 28 and secure the device 10 in the deployed configuration.

Figure 18:
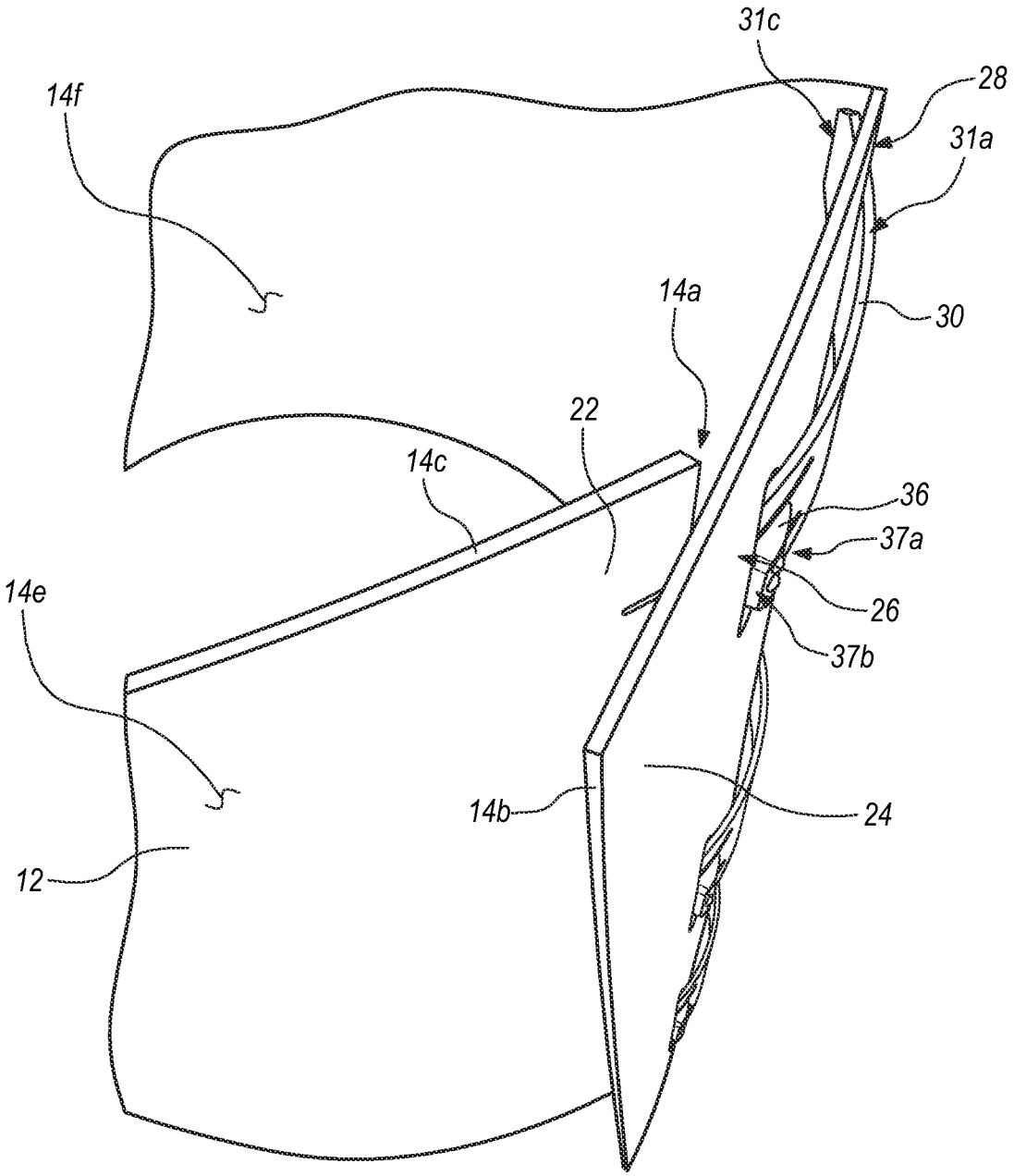
FIG. 18 is an outside perspective view of another exemplary projection of another exemplary implementation of a rescue device secured in first and second through apertures.
Figure 19:
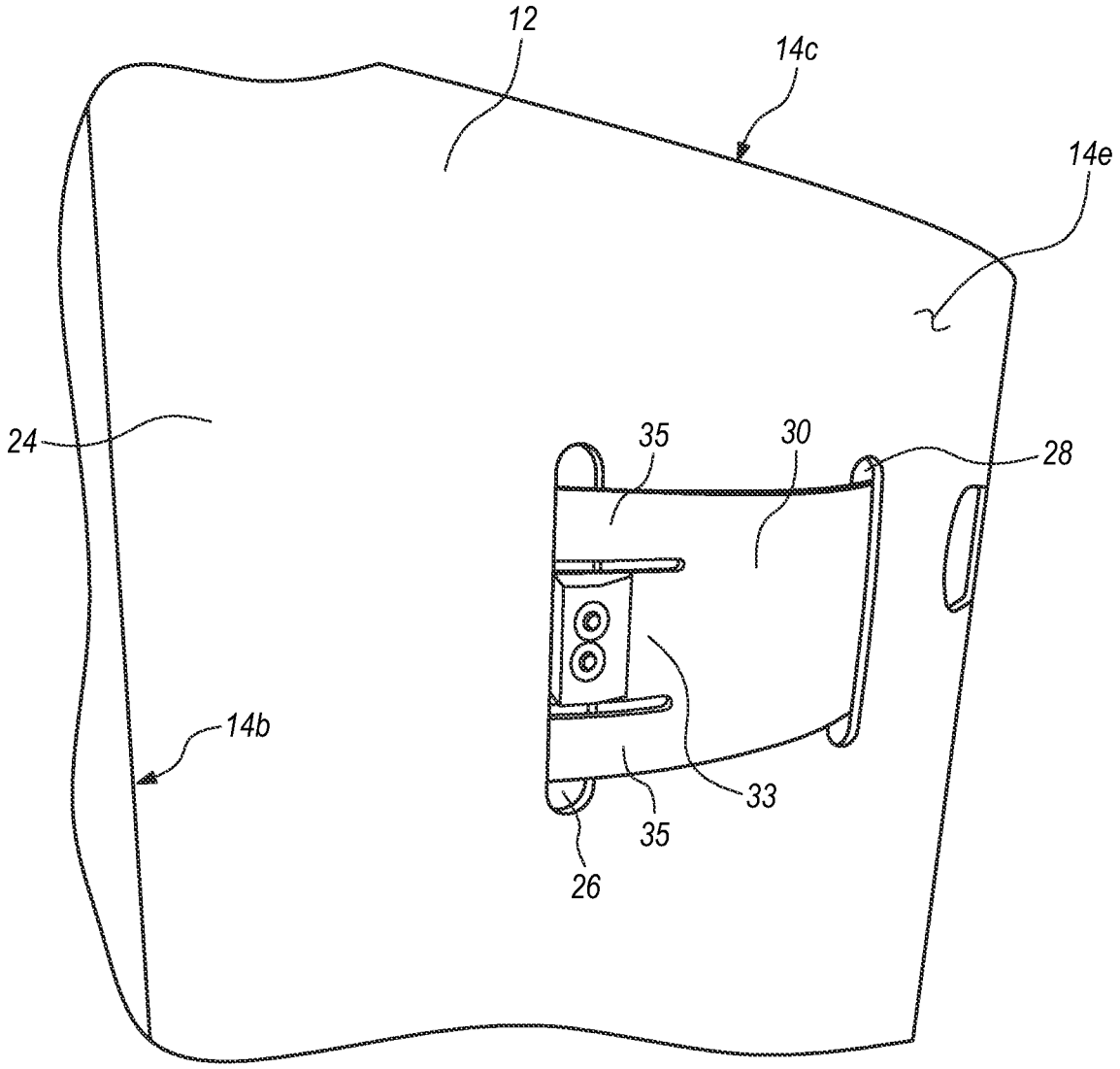
FIG. 19 is an outside view thereof another secured in first and second through apertures.
Figure 20:
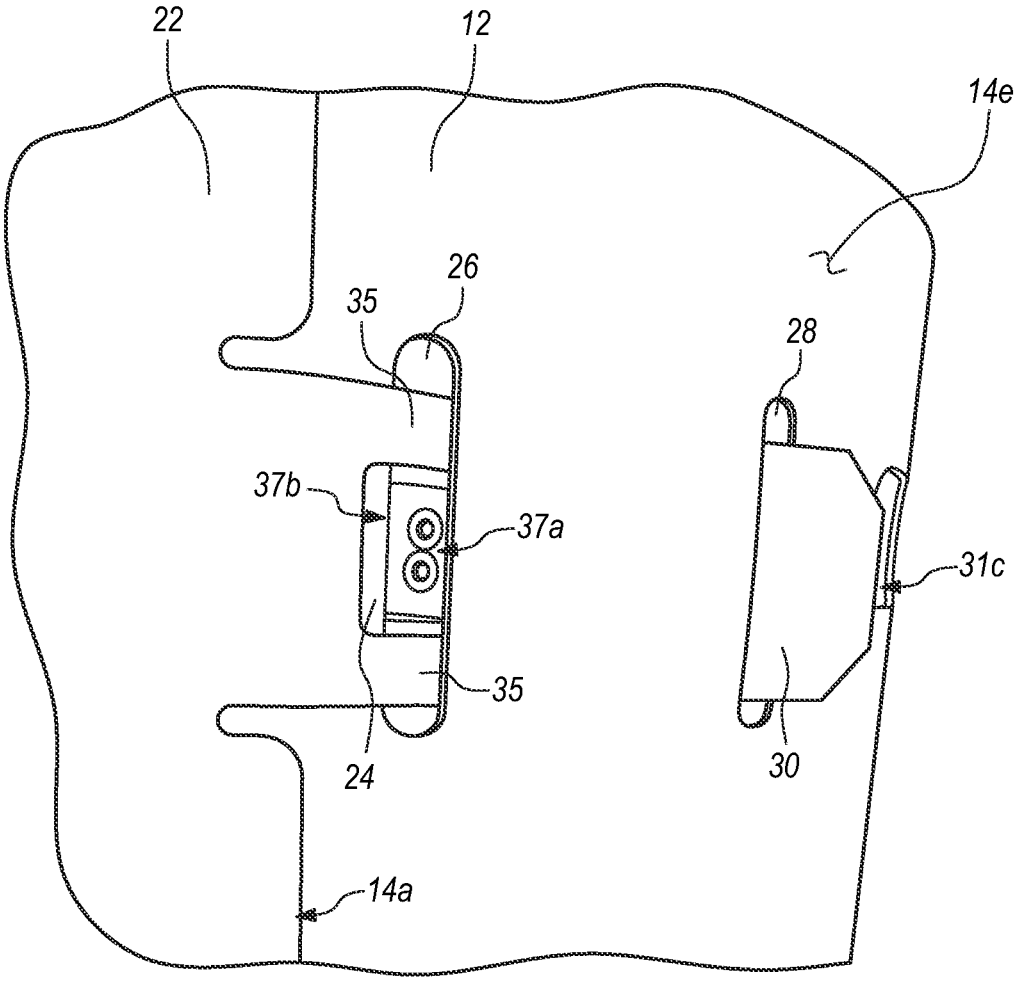
FIG. 20 is an outside view thereof secured in first and second through apertures.

In other embodiments, as shown in FIGS. 18-20, when the securing element 32 is the stopper 36, the stopper 36 may permit the projection 30 to be inserted through the first and second through apertures 26, 28 and prevent the projection 30 from being retracted back through the first aperture 26. For example, the edge of the sheet 12 at the first through aperture 26 may pass over the yield surface 37*a* of the stopper 36 as the projection 30 is passed through the first and second through apertures 26, 28 and, after the stopper 36 has been passed through the first and second through apertures 26, 28, the abutment surface 34*b* of the stopper 36 may abut the edge of the sheet 12 at the first through aperture 26 if the stopper 36 is retracted toward the first through aperture 26. The abutment between the abutment surface 34*b* of the stopper 36 and the sheet 12 at the first through aperture 26 may thereby prevent the projection 30 from being retracted back through the first through aperture 26. The natural biasing force of the rescue device 10 to unroll from the deployed state may continually bias the abutment surface 34*b* against the edge of the sheet 12 at the first through aperture 26 and thereby retain the projection 30 in the first and second through apertures 26, 28 and secure the device 10 in the deployed configuration.

The one or more projections 30 may be secured in the first and second through apertures 26, 28 in any suitable manner. For example, each of the one or more projections 30 may be passed through the corresponding first through aperture 26 and corresponding second through aperture 28 and secured by the securing element 32 one by one or the all projections 30 may be passed through the corresponding first through aperture 26 and all projections 30 may be passed through the corresponding second through aperture 28 at the same time. The securing element 32 may be affixed to the projection 30 before the projection 30 has been passed through the first and/or second apertures 26, 28 or may be affixed to the projection 30 after the projection edge 31*c* has been passed through the first and second through apertures 26, 28. In some embodiments, the securing element 32 may be secured to the sheet 12 after the projection edge 31*c* has been passed through the first and second through apertures 26, 28, such as when embodiments where the securing element 32 is a bolt, buckle, tie, snap, screw, nut, or other fastener.

While the rescue device 10 has been described as having one or more projections 30 extending laterally outward from the first end 14*a* and one or more first and second through apertures 26, 28 near the second end 14*b*, the rescue device 10 may have any suitable configuration of projections 30 and through apertures 26, 28. For example, the rescue device 10 may have projections 30 extending laterally outward from the second end 14*b* and first and second through apertures 26, 28 near the first end 14*a* or the rescue device 10 may have projections 30 extending laterally outward from the first and second ends 14*a*, 14*b* and first and second through apertures 26, 28 near both the first and second ends 14*a*, 14*b*, corresponding to the projections 30.

As shown in FIGS. 1, 4, 11-15 21, the bottom edge 14*d* of the sheet 12 may be shaped or otherwise configured to permit the rescue device 10 be easily inserted into a pile of grain or other substance and/or to assist in gripping grain or other substance during a rescue operation. For example, the bottom edge 14*d* may be tapered, serrated, notched, jagged, scored, saw-toothed, or any other shape or configuration. As shown in FIGS. 11-15, the bottom edge 14*d* may include a plurality of teeth 40 which extend substantially along the length of the bottom edge 14*d*.

In exemplary embodiments, the rescue device 10 is made of a material and designed such that, when the device 10 is in the deployed state, it may easily fit around an individual trapped in grain and impede surrounding grain from continuing to engulf the individual. When the device 10 is in the deployed state, the device 10 has a diameter between about 24 inches and about 35 inches. In an exemplary embodiment, the device 10 has a diameter between about 26 and 28 inches in the deployed state. For example, the rescue device 10 may have a diameter of about 28 inches when the projections 30 are inserted in the first through apertures 26 and the rescue device 10 may have a diameter of about 26 inches when the projections 30 are inserted in the second through apertures 28.

Optionally, the rescue device 10 may be rolled into the undeployed or rolled state and placed or packaged in a carrying case, either before or after use. The carrying case which may be then slung over a shoulder of a rescuer to carry the rescue device through a narrow grain silo and to the rescue site. Carrying the rescue device 10 in such a manner allows the rescuer to move hands-free to a rescue site, allowing the rescuer to easily maneuver through small or narrow passages, such as a grain silo door. Once at the rescue location, the user may then remove the rescue device 10 from the carrying case and begin the rescue operation.

Figure 22:
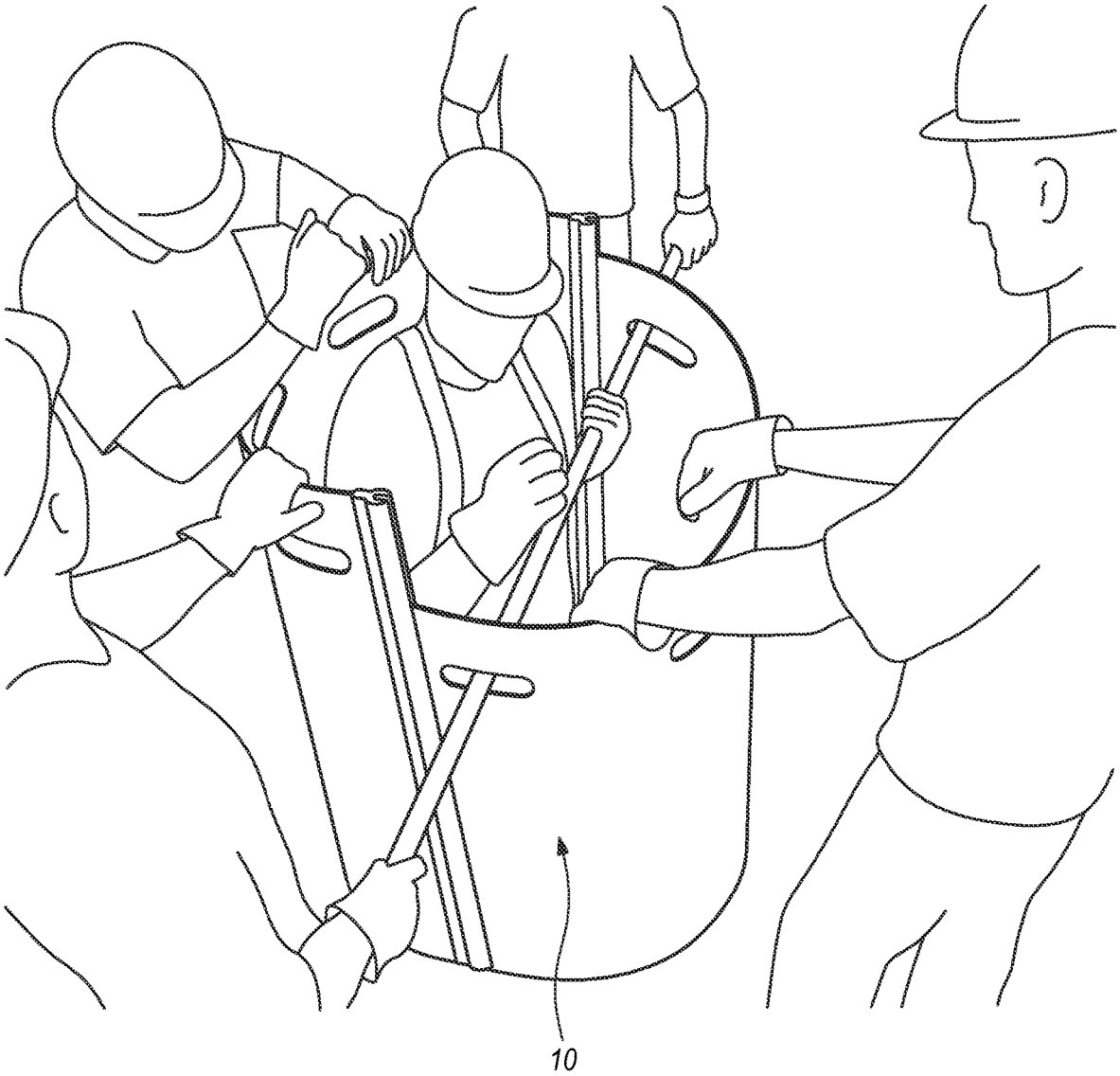
FIG. 22 illustrates a rescue of an individual trapped in grain using an exemplary rescue device.

In use, after a victim has become trapped in a gain pile inside a silo, a rescue worker can enter through the narrow entry of the silo with the rescue device 10 in the rolled or undeployed state, either carrying the device 10 directly or with a carrying case. The worker may then quickly release the rescue device 10 from the undeployed state by removing the band 40 from the rescue device 10. The user may then unroll the rescue device 10 such that the projections 30 are aligned with and adjacent to the first through apertures 26. The user may then insert the projection edge 31*c* of the projections 30 through the first and second through apertures 26, 28 such that the securing element 32 prevents the projection edge 31*c* from being retracted through the first through aperture 26. The rescue worker then places the rescue device 10 above and around the trapped individual and pushes the device 10 downward into the grain. The rescue worker may use the hand receiving areas H to place the device 10 more easily and to exert downward pressure on the device 10. The downward movement and placement of the rescue device 10 around the individual stops the grain from further closing in on the individual and prevents possible suffocation. As shown in FIG. 22, the rescue device 10 in the deployed state has a large enough diameter to surround the individual trapped in the grain. In exemplary embodiments, the rescue device 10, acting as a barrier between the grain and the individual, thereby permits the rescue worker to free the trapped individual by allowing the worker to dig the individual out.

Once the trapped individual has been removed from the grain or other material, the rescue device may be returned to the rolled or undeployed state. The user would release the rescue device 10 from the deployed state by further inserting the projections 30 through the first and second through apertures 26, 28 and thereby releasing the securing element 32 from its securing engagement with the edge of the sheet 12 at the first through aperture 26. Once the projections 30 are removed from the first and second through apertures 26, 28, the user would then roll the rescue device 10 inwardly on itself to the rolled configuration such that the diameter of the rescue device 10 is less than the diameter of the rescue device 10 in the deployed configuration. The user may then secure the rescue device 10 in the rolled configuration with the band 40. In exemplary embodiments, the rescue device 10 may then be placed in a carrying case or otherwise stored for later use.

In exemplary embodiments, the rescue device 10 of the present invention is not limited to use in a farm environment but has many applications in other environments, such as industrial environments, cave or mining environments, etc. In addition, the rescue device 10 can be used in a variety of different materials or substances, such as sand, dirt, mud, salt, etc., plastic materials, and dry or semi-dry materials. In other settings, the size, thickness, and material of the rescue device 10 may be altered so that the rescue device is as light as possible and may be rolled into the smallest diameter possible while still having a deployed state that may fit around a trapped individual repel surrounding materials so that the individual may be rescued.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, the rescue device 10 may be placed in a bag in a rolled configuration or state. The rescue device 10 may then be released such that rescue device 10 unrolls and expands to the maximum opening size of the bag. With the rescue device 10 disposed within the bag, the open bag may be freestanding and may be loaded with materials or debris such as hay, trash, or leaves. After the bag has been filled, the rescue device 10 may be removed and the bag may be closed and/or secured. Additionally, the steps of all processes and methods herein can be performed in any order, unless two or more steps are expressly stated as being performed in a particular order, or certain steps inherently require a particular order. Accordingly, departures may be made from such details without departing from the spirit or scope of the applicant's general inventive concept.

What is claimed is:

1. A rescue device to assist in removing an individual trapped in material in a confined space, the rescue device comprising:

a sheet having a first end, a second end, an upper portion, a bottom edge, a first through aperture, and a second through aperture; and a projection extending laterally outward from the first end and having a top edge, a bottom edge, a projection edge, and a securing element;

the sheet being adapted to curl around and the sheet having a plurality of hand receiving areas in the upper portion of the sheet;

the first through aperture being inset from the second end and the second through aperture being inset from the first through aperture;

the sheet being rollable between an undeployed position and a deployed position wherein the projection is configured to pass through the first and second through apertures;

wherein the projection is configured to be secured by the securing element;

wherein the securing element comprises a clip partially cut out of the projection;

wherein the projection further comprises a clip edge and two legs between the clip and the top and bottom edges of the projection;

wherein the clip edge is oriented in an opposite direction to the projection edge of the projection;

wherein the clip is configured such that it flexes away from the legs and thereby defines a sheet receiving space between the clip and the legs; and wherein a portion of the sheet is disposed within the sheet receiving space between the clip and legs of the projection when the rescue device is in the deployed position and when the projection is through the first and second apertures and secured by the securing element.

2. The rescue device of claim 1, wherein the bottom edge of the sheet is serrated.

3. The rescue device of claim 1, wherein the sheet has a length of about 96 inches and a height of about 40 inches.

4. The rescue device of claim 1, wherein the projection is vertically aligned with the first through aperture, and each of the projection and the first through aperture are vertically aligned with the second through aperture.

5. The rescue device of claim 1, wherein the rescue device further comprises at least one additional projection, at least one additional first through aperture, and at least one additional second through aperture.

6. The rescue device of claim 1, wherein at least two of the plurality of hand receiving areas are opposite each other when the device is in the deployed position.

7. The rescue device of claim 1, wherein the clip is substantially rectangular.

8. The rescue device of claim 1, wherein the sheet further comprises a high-density polyethylene.

9. A rescue device to assist in removing an individual trapped in material in a confined space, the rescue device comprising:

a sheet having a first end, a second end, a top edge, a bottom edge, an upper portion, a first through aperture, and a second through aperture; and a projection extending laterally outward from the first end and having a top edge, a bottom edge, a projection edge, and a securing element;

wherein the securing element comprises a clip partially cut out of the projection, wherein the projection further comprises a clip edge and two legs between the clip and the top and bottom edges of the projection; and wherein the clip is configured such that it flexes away from the legs and thereby defines a sheet receiving space between the clip and the legs;

the sheet being adapted to curl around and the sheet having a plurality of hand receiving areas in the upper portion of the sheet;

the first through aperture being inset from the second end and the second through aperture being inset from the first through aperture;

the sheet being rollable between an undeployed position and a deployed position wherein the projection is configured to pass through the first and second through apertures, and wherein the projection is configured to be partially secured by the securing element;

wherein the first and second through apertures are vertically aligned with the projection;

wherein the bottom edge of the sheet is serrated; and wherein the projection is prevented from being retracted through the first through aperture when a portion of the sheet proximate the first aperture is within the sheet receiving space, and the clip is on an opposite side of the sheet as the legs when the rescue device is in the deployed position wherein the projection is through the first and second apertures and secured by the securing element.

10. The rescue device of claim 9, wherein the clip is substantially rectangular.

11. The rescue device of claim 9, wherein the sheet further comprises a high-density polyethylene.

12. A rescue device to assist in removing an individual trapped in material in a confined space, the rescue device comprising:

a sheet having a first end, a second end, an upper portion, a bottom edge, a first through aperture, and a second through aperture; and a projection extending laterally outward from the first end and having a top edge, a bottom edge, a projection edge, and a securing element;

the sheet being adapted to curl around and the sheet having a plurality of hand receiving areas in the upper portion of the sheet;

the first through aperture being inset from the second end and the second through aperture being inset from the first through aperture;

the sheet being rollable between an undeployed position and a deployed position wherein the projection is configured to pass through the first and second through apertures;

wherein the projection is configured to be secured by the securing element;

wherein the securing element comprises a clip partially cut out of the projection;

wherein the projection further comprises a clip edge and two legs between the clip and the top and bottom edges of the projection;

wherein the clip edge is oriented in an opposite direction to the projection edge of the projection;

wherein the clip is configured such that it flexes away from the legs and thereby defines a sheet receiving space between the clip and the legs;

wherein a portion of the sheet is disposed within the sheet receiving space between the clip and legs of the projection when the rescue device is in the deployed position and when the projection is through the first and second apertures and secured by the securing element; and wherein the projection is retained in the first and second through apertures by a natural biasing force of the rescue device to unroll from the deployed position, such that the portion of the sheet is biased into the sheet receiving space between the clip and the legs of the projection.

* * * * *